US009298158B1

(12) United States Patent
Sono et al.

(10) Patent No.: US 9,298,158 B1
(45) Date of Patent: Mar. 29, 2016

(54) IMAGE FORMING APPARATUS WITH GUIDE MECHANISM FOR IMAGE WRITER

(71) Applicant: FUJI XEROX CO., LTD., Tokyo (JP)

(72) Inventors: Yuichi Sono, Kanagawa (JP); Masami Sakurai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/717,450

(22) Filed: May 20, 2015

(30) Foreign Application Priority Data

Dec. 4, 2014 (JP) ..... 2014-245960

(51) Int. Cl.
*G03G 15/00* (2006.01)
*G03G 21/16* (2006.01)
*G03G 21/18* (2006.01)

(52) U.S. Cl.
CPC ..... *G03G 21/1842* (2013.01); *G03G 21/1666* (2013.01)

(58) Field of Classification Search
CPC ..... G03G 21/1842; G03G 21/1666
See application file for complete search history.

(56) References Cited

U.S. PATENT DOCUMENTS 6,252,619 B1 * 6/2001 Ueda ..... G03G 21/1628 347/138
8,150,294 B2 * 4/2012 Okabe ..... G03G 15/0131 399/110
8,311,437 B2 * 11/2012 Sato ..... G03G 21/1846 399/110
8,364,059 B2 * 1/2013 Kato ..... G03G 21/1647 399/111
8,773,486 B2 * 7/2014 Nakamura ..... B41J 2/325 347/238

FOREIGN PATENT DOCUMENTS

JP H06-106814 A 4/1994

* cited by examiner

*Primary Examiner* — G. M. Hyder
(74) *Attorney, Agent, or Firm* — Oliff PLC

(57) ABSTRACT

An image forming apparatus includes an apparatus housing having an opening and closing door, an attaching body, an image writer, and a guide mechanism. The guide mechanism moves the image writer in conjunction with opening and closing of the opening and closing door, guides the image writer to a write position upon closing the opening and closing door, and guides the image writer to a retracted position upon opening the opening and closing door. The guide mechanism has a first guide mechanism that moves the image writer along a first guide portion provided in the attaching body while the opening and closing door moves from the close position to an intermediate position, and a second guide mechanism that guides the image writer along a second guide portion provided in the apparatus housing while the opening and closing door moves from the intermediate position to the open position.

8 Claims, 22 Drawing Sheets

IMAGE FORMING APPARATUS WITH GUIDE MECHANISM FOR IMAGE WRITER

CROSS-REFERENCE TO RELATED APPLICATIONS

This application is based on and claims priority under 35 USC 119 from Japanese Patent Application No. 2014-245960 filed Dec. 4, 2014.

BACKGROUND

Technical Field

The present invention relates to an image forming apparatus.

SUMMARY

According to an aspect of the invention, there is provided an image forming apparatus including an apparatus housing that has an opening and closing door that opens and closes between a close position and an open position, an attaching body that includes an image carrier that carries an image, the attaching body being detachably attached inside the apparatus housing through an opening of the opening and closing door in a direction crossing an axial direction of the image carrier, an image writer that is opposed to the image carrier to write an image onto the image carrier, and a guide mechanism that moves the image writer in conjunction with opening and closing of the opening and closing door, the guide mechanism guiding the image writer to a write position upon closing of the opening and closing door and guiding the image writer to a retracted position upon opening of the opening and closing door, the retracted position being a position in which the image writer is retracted from a space for attaching and detaching the attaching body. The guide mechanism has a first guide mechanism that has a first guide portion provided in the attaching body, the first guide mechanism guiding the image writer along the first guide portion while the opening and closing door moves from the close position to an intermediate position, the intermediate position being located between the close position and the open position, and a second guide mechanism that has a second guide portion provided in the apparatus housing, the second guide mechanism guiding the image writer along the second guide portion while the opening and closing door moves from the intermediate position to the open position.

BRIEF DESCRIPTION OF THE DRAWINGS

Exemplary embodiments of the present invention will be described in detail based on the following figures, wherein.

DETAILED DESCRIPTION

General Overview of Exemplary Embodiments

Figure 1:
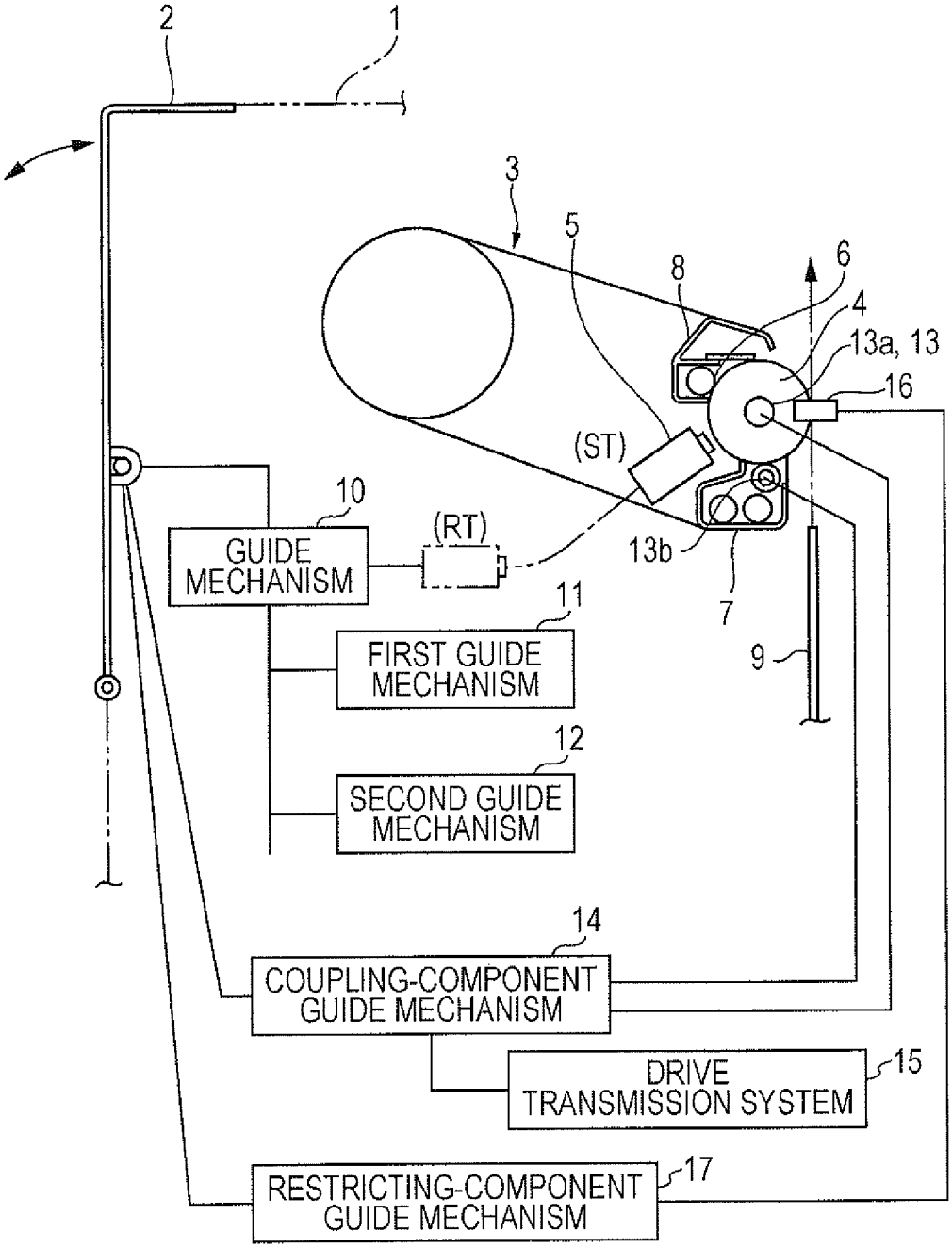
FIG. 1 illustrates a general overview of an image forming apparatus according to exemplary embodiments of the invention.

FIG. 1 illustrates a general overview of an image forming apparatus according to exemplary embodiments of the invention.

Figure 2:
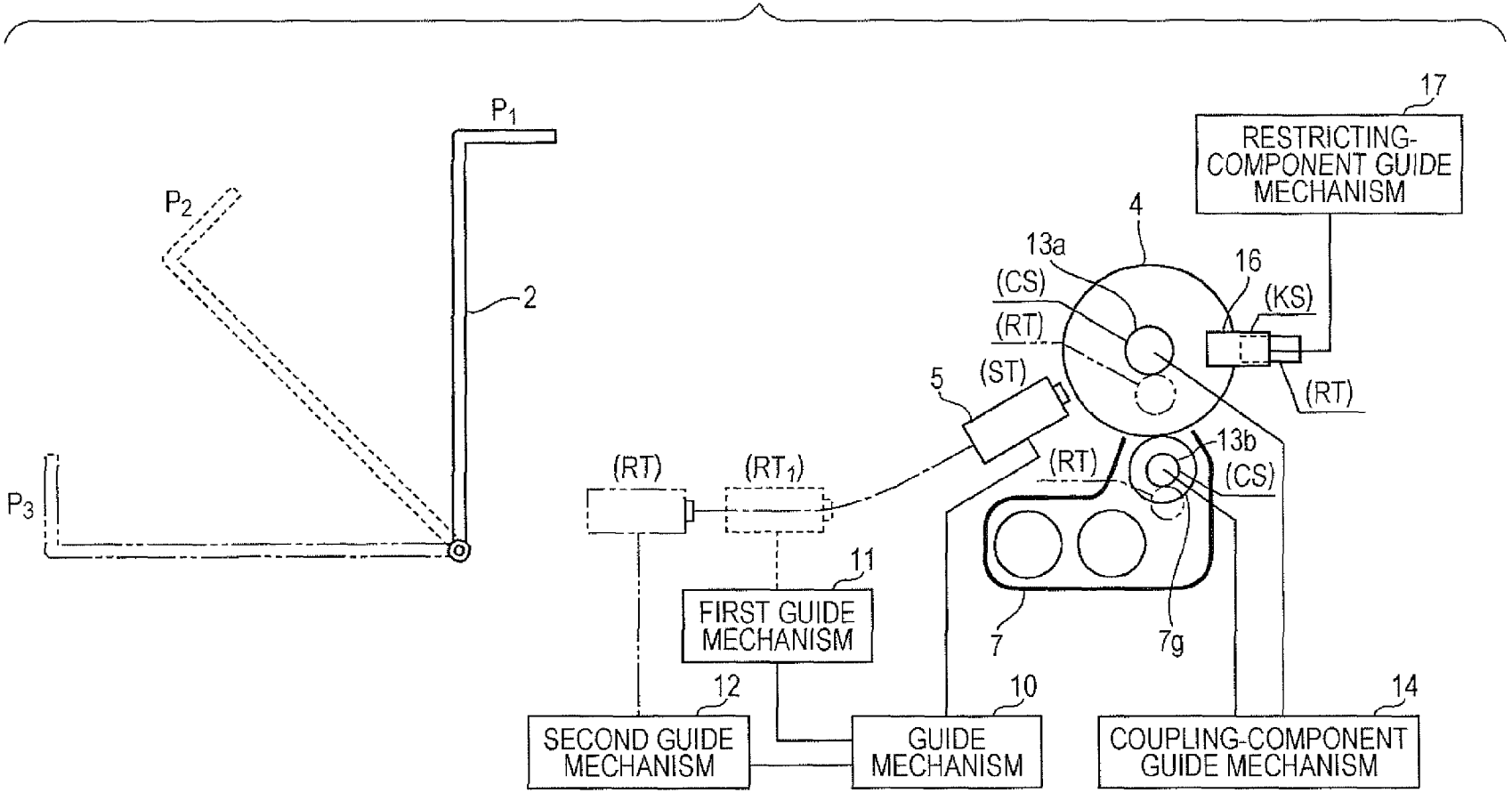
FIG. 2 illustrates the behaviors of various guide mechanisms associated with opening and closing of an opening and closing door in the image forming apparatus illustrated in FIG. 1.

In FIG. 1, the image forming apparatus includes an apparatus housing 1, a process cartridge 3, an image writer 5, and a guide mechanism 10. The apparatus housing 1 has an opening and closing door 2 that opens and closes between a close position and an open position. The process cartridge 3, which includes an image carrier 4 that carries an image, is an attaching body that is detachably attached inside the apparatus housing 1 through the opening of the opening and closing door 2 in a direction crossing the axial direction of the image carrier 4. The image writer 5 is opposed to the image carrier 4 to write an image onto the image carrier 4. The guide mechanism 10, which moves the image writer 5 in conjunction with opening and closing of the opening and closing door 2, guides the image writer 5 to a write position ST upon closing of the opening and closing door 2, and guides the image writer 5 to a retracted position RT, which is retracted from the space for attaching and detaching the process cartridge 3, upon opening of the opening and closing door 2. The guide mechanism 10 has a first guide mechanism 11 and a second guide mechanism 12. As illustrated in FIG. 2, the first guide mechanism 11 guides the image writer 5 along a first guide portion provided in the process cartridge 3 while the opening and closing door 2 moves from a close position $P_1$ to an intermediate position $P_2$ located between the closed position $P_1$ and an open position $P_3$, and the second guide mechanism 12 guides the image writer 5 along a second guide portion provided in the apparatus housing 1 while the opening and closing door 2 moves from the intermediate position $P_2$ to the open position $P_3$.

In FIG. 1, the process cartridge 3 adopts, for example, an electrophotographic system. The process cartridge 3 is implemented as an assembly integrally incorporating, in addition to the image carrier 4, a charging unit 6 that electrically charges the image carrier 4, a developing unit 7 that develops, with a developer, an electrostatic latent image that is an image written by the image writer 5 onto the image carrier 4, and a cleaning unit 8 that cleans residues on the image carrier 4. A developed image formed on the image carrier 4 of the process cartridge 3 is transferred to a recording medium 9 by a transfer unit (not illustrated).

In the present example, the opening and closing door 2 may be provided in a side peripheral portion or top portion of the apparatus housing 1. The term side peripheral portion as used herein refers to a wall portion surrounding the side periphery of the apparatus housing 1. In many cases, the opening and closing door 2 is disposed on the near side of the apparatus housing 1 as seen from the user. However, because the apparatus housing 1 may be installed in any direction, the exemplary embodiments include a wide variety of configurations in which the opening and closing door 2 is arranged in any given location on the side peripheral portion of the apparatus housing 1.

By taking into consideration those cases where the process cartridge 3 and the image writer 5 interfere with each other at the time of attaching or detaching the process cartridge 3, in the exemplary embodiments, the process cartridge 3 is attached or detached in a direction crossing the axial direction of the image carrier 4.

Further, the image writer 5 may be any image writer that is opposed to the image carrier 4 to write an image onto the image carrier 4. As the image writer 5, an LED print head (to be abbreviated as LPH hereinafter), an ion write head, or the like may be selected as appropriate.

Furthermore, the guide mechanism 10 is required to guide the image writer 5 between the write position ST and the retracted position RT in conjunction with opening and closing of the opening and closing door 2. In this regard, in order to avoid interference of the process cartridge 3 with the image writer 5 at the time of attaching or detaching the process cartridge 3, it is required to set the retracted position RT as a location in which the image writer 5 is retracted from the space necessary for attaching and detaching the process cartridge 3.

The first guide mechanism 11 may be any guide mechanism that guides the image writer 5 along the first guide portion provided in the process cartridge 3. The guide path in the first guide portion may be selected as appropriate. In this regard, when the image writer 5 reaches the image carrier 4 side after being guided along the first guide portion, the image writer 5 is positioned in a predetermined write position ST with respect to the image carrier 4 positioned in the process cartridge 3. Further, upon opening the opening and closing door 2 from the close position $P_1$ to the intermediate position $P_2$, as illustrated in FIG. 2, the image writer 5 is guided to an intermediate retracted position $RT_1$ retracted from the write position ST. At this time, in the intermediate retracted position $RT_1$, the image writer 5 is located in the vicinity of the entrance to the first guide portion of the process cartridge 3.

The second guide mechanism 12 may be any guide mechanism that guides the image writer 5 along a second guide portion provided in the apparatus housing 1. The guide path in the second guide portion may be set as appropriate. In this regard, when the opening and closing door 2 reaches the open position $P_3$, as illustrated in FIG. 2, the image writer 5 reaches the retracted position RT retracted from the space for attaching and detaching the process cartridge 3.

Next, various exemplary embodiments of the image forming apparatus will be described below.

First, in one exemplary embodiment, in the guide mechanism 10, the first guide mechanism 11 has a first guide portion having a linear shape, and the second guide mechanism 12 has a second guide portion that changes the image writer 5 to an orientation different from that in the first guide portion. In the present example, the image writer 5 that has changed to a predetermined orientation after being guided through the second guide portion of the second guide mechanism 12 is passed to the first guide mechanism 11. Then, the image writer 5 gradually changes its orientation while moving along the first guide portion of the first guide mechanism 11 which has a linear shape until, finally, the image writer 5 is positioned in the write position ST where the image writer 5 is held in its normal orientation.

In one exemplary embodiment, a holding mechanism for the image writer 5 has a holding member that holds the image writer 5 in a manner that allows the image writer 5 to advance and retract, and an urging member that urges the image writer 5 in a direction in which the image writer 5 advances. The holding member has a guided portion that engages with each of the guide portions of the first and second guide mechanisms 11 and 12. In the present example, in addition to holding the image writer 5 in a manner that allows its movement between the write position ST and the retracted position RT, the holding mechanism for the image writer 5 is required to adjust the position of the image writer 5 at the time of positioning the image writer 5 in the write position ST of the process cartridge 3. Such a position adjusting mechanism may be implemented by, for example, holding the image writer 5 in a manner that allows its advancing and retracting movement, and also urging the image writer 5 by the urging member in the direction in which the image writer 5 advances.

In one exemplary embodiment, in the holding mechanism for the image writer 5, the holding member has a pivot point located on the side of the holding member away from the position where the image writer 5 is held, and the holding member swings about this pivot point to change the orientation of the image writer 5.

In the case of a configuration in which this type of holding mechanism is adopted, in one exemplary embodiment, the first guide mechanism 11 has a guide groove and a protrusion. The guide groove has a linear shape, and is provided in the process cartridge 3 as the first guide portion. The protrusion is provided as the guided portion in a part of the holding member located away from the pivot point, and protrudes so as to slidably fit in the guide groove. Further, in one exemplary embodiment, the second guide mechanism 12 has a guide surface and an overhanging member. The guide surface is provided in the apparatus housing 1 as the second guide portion. The overhanging member is provided as the guided portion in a part of the holding member located away from the pivot point, and overhangs so as to run onto the guide surface to change the image writer 5 to an orientation directed toward the first guide mechanism 11.

In one exemplary embodiment, the process cartridge 3 has a driven component including the image carrier 4, a drive transmission system 15 that transmits a driving force to the driven component has a coupling component 13 that couples to the driven component, and the image forming apparatus includes a coupling-component guide mechanism 14. The coupling-component guide mechanism 14, which moves the coupling component 13 in conjunction with opening and closing of the opening and closing door 2, guides the coupling component 13 to a coupling position CS upon closing of the opening and closing door 2, and guides the coupling component 13 to a retracted position RT, which is retracted from the space for attaching and detaching the process cartridge 3, upon opening of the opening and closing door 2. When the opening and closing door 2 is opened from the close position $P_1$ to the open position $P_3$, the coupling-component guide mechanism 14 moves the coupling component 13 to the retracted position RT after guiding of the image writer 5 by the second guide mechanism 12 is started.

In other words, the coupling-component guide mechanism 14 of this type may, at the time of opening the opening and closing door 2 from the close position $P_1$ to the open position $P_3$, move the coupling component 13 to the retracted position RT after the image writer 5 leaves the first guide portion provided in the process cartridge 3.

In one exemplary embodiment, the process cartridge 3 has, as a driven component, a developing unit 7 that develops an image written onto the image carrier 4 by the image writer 5 into a visible image. The coupling-component guide mechanism 14 guides the coupling component 13 capable of coupling to the image carrier 4 and a developing member 7*g* of the developing unit 7 which are driven components, to the coupling position CS and the retracted position RT.

Further, in one exemplary embodiment, the coupling-component guide mechanism 14 operates in conjunction with opening and closing of the opening and closing door 2 via the guide mechanism 10 for the image writer. In the present example, the coupling-component guide mechanism 14 operates in conjunction with opening and closing of the opening and closing door 2 via the guide mechanism 10.

In the case of a configuration in which the amount of guide by the coupling-component guide mechanism 14 is smaller than the amount of guide by the guide mechanism 10 for the image writer, the coupling-component guide mechanism 14 may have a portion that engages with a movable member of the guide mechanism 10 via an elongated hole to absorb the difference in the amount of guide.

In one exemplary embodiment, the image forming apparatus includes a restricting component 16 and a restricting-component guide mechanism 17. The restricting component 16 restricts dislodging of the image carrier 4 in the axial direction. The restricting-component guide mechanism 17, which moves the restricting component 16 in conjunction with opening and closing of the opening and closing door 2, guides the restricting component 16 to a restricting position KS upon closing of the opening and closing door 2, and guides the restricting component 16 to a retracted position RT, which is retracted from the space for attaching and detaching the process cartridge 3, upon opening of the opening and closing door 2. When the opening and closing door 2 is opened from the close position $P_1$ to the open position $P_3$, the restricting-component guide mechanism 17 moves the restricting component 16 to the retracted position RT after guiding of the image writer 5 by the second guide mechanism 12 is started.

Further, in one exemplary embodiment, the restricting-component guide mechanism 17 operates in conjunction with opening and closing of the opening and closing door 2 via the guide mechanism 10 for the image writer. In the present example, the restricting-component guide mechanism 17 operates in conjunction with opening and closing of the opening and closing door 2 via the guide mechanism 10.

Hereinafter, the exemplary embodiments of the invention will be described in more detail with reference to the attached figures.

Exemplary Embodiment 1

Figure 3:
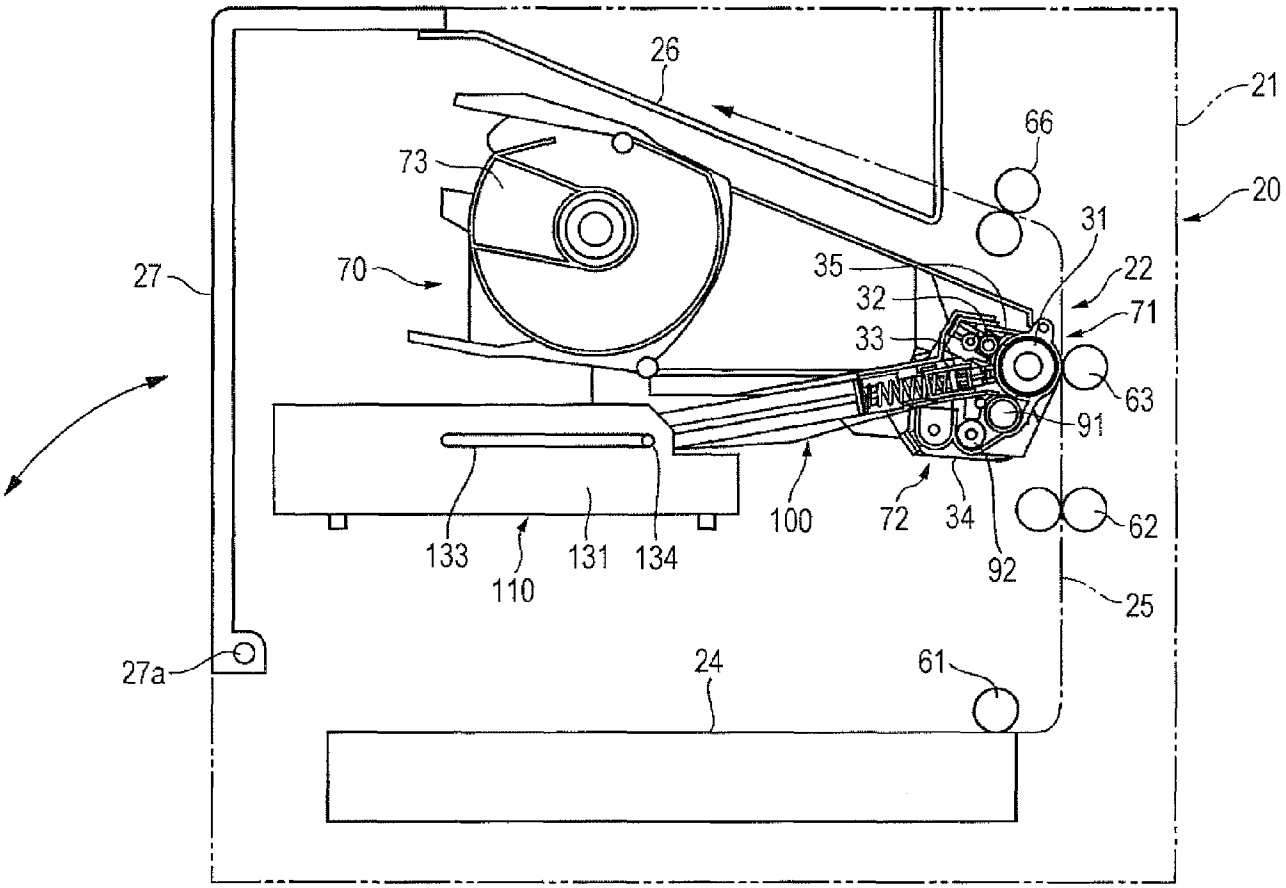
FIG. 3 illustrates a general configuration of an image forming apparatus according to Exemplary Embodiment 1.
Figure 4:
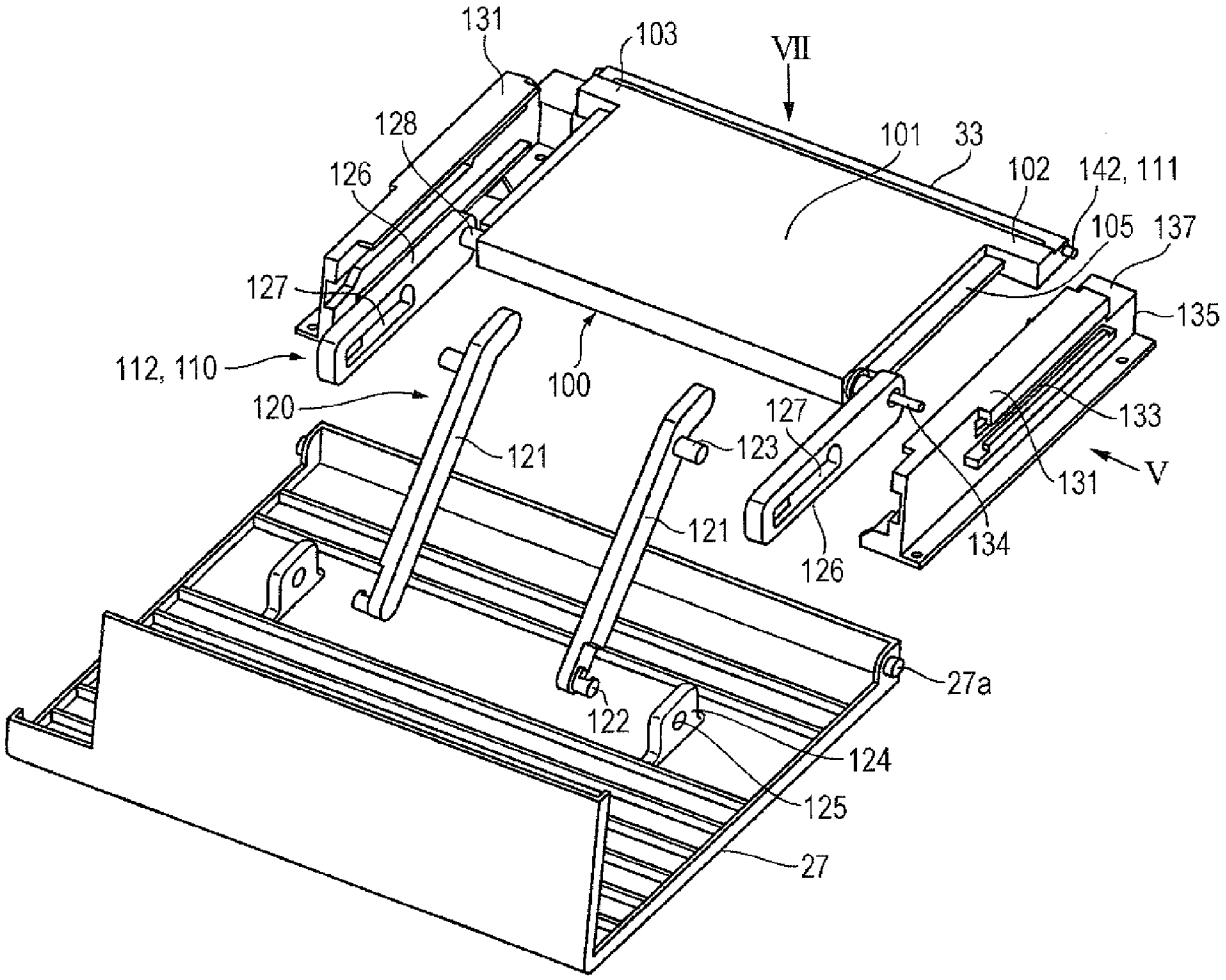
FIG. 4 is an exploded perspective view illustrating a guide mechanism for an image writer, and an interlock mechanism which are used in Exemplary Embodiment 1.
Figure 5:
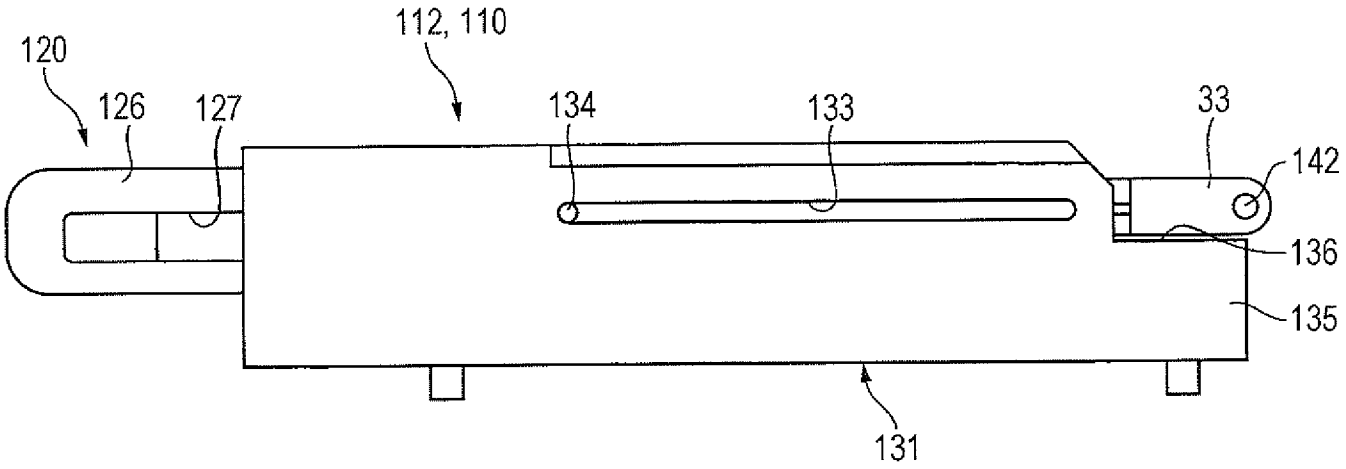
FIG. 5 is a view as seen in the direction of an arrow V in FIG. 4.
Figure 6:
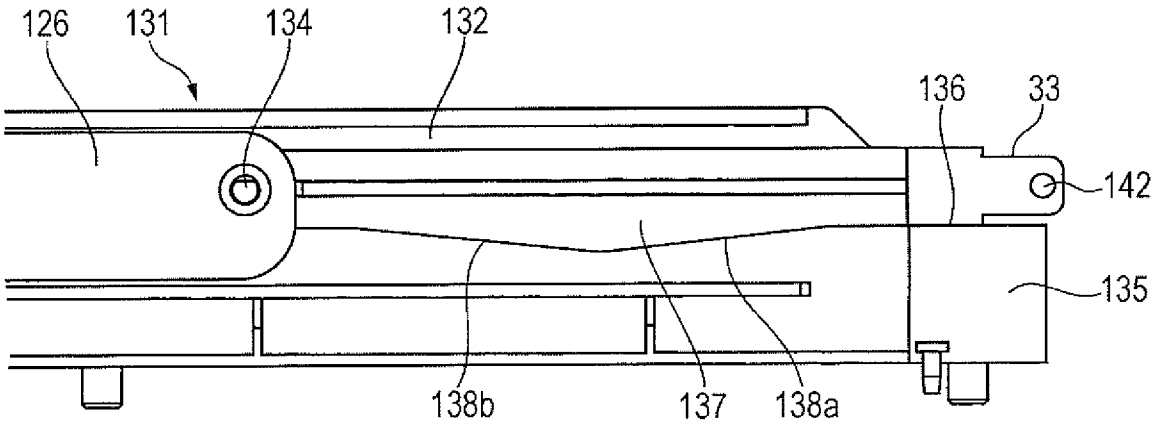
FIG. 6 illustrates a major portion of a second guide mechanism.
Figure 7:
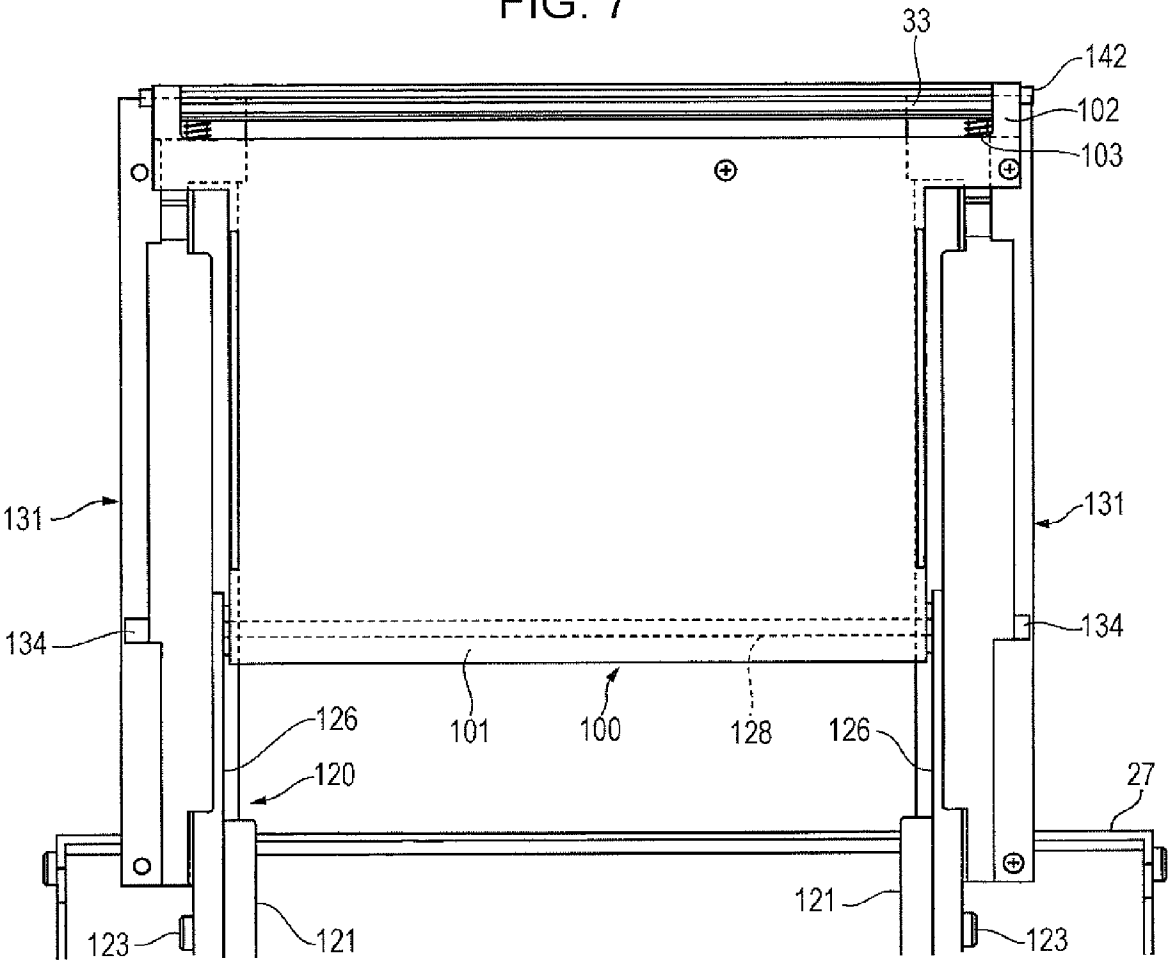
FIG. 7 is a view as seen in the direction of an arrow VII in FIG. 4.
Figure 8:
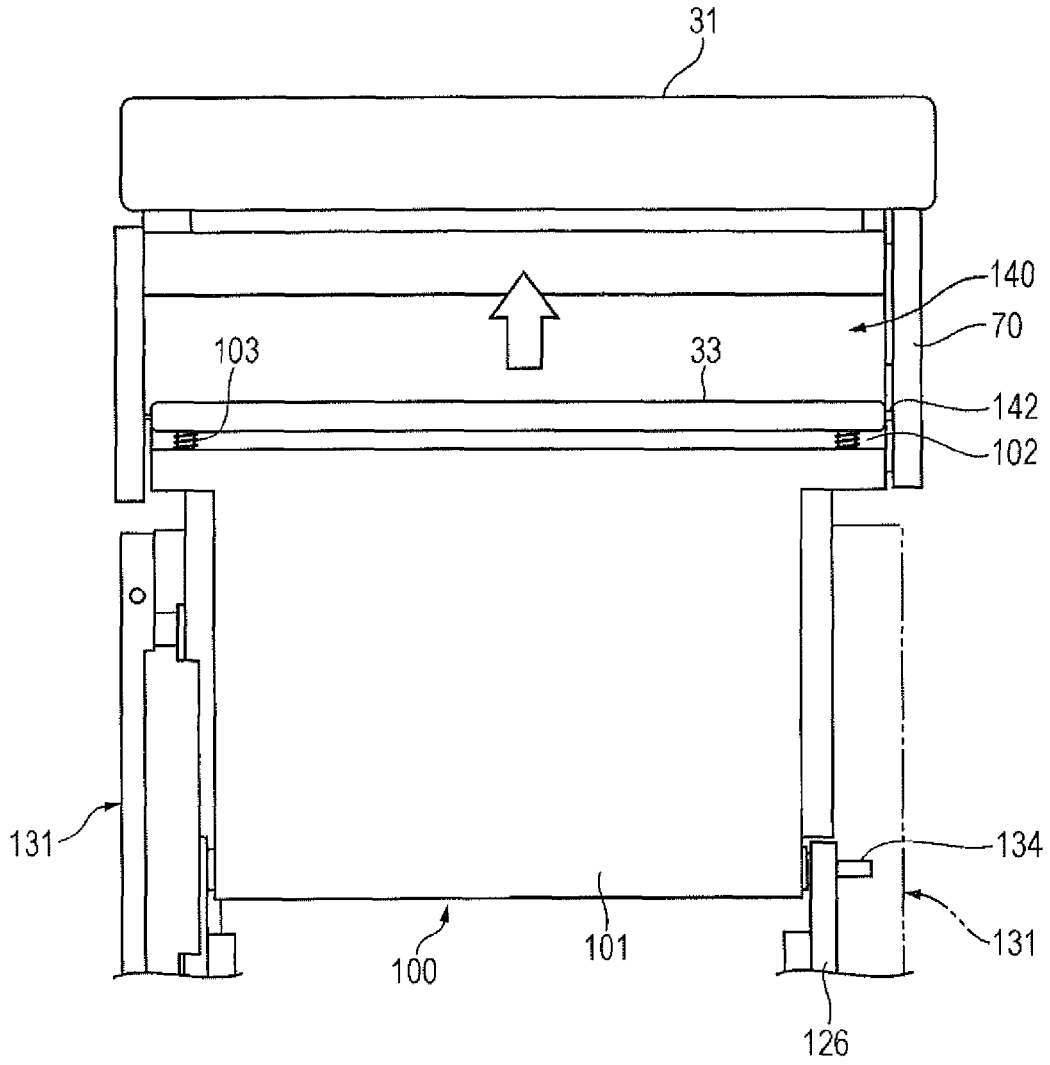
FIG. 8 illustrates the relationship between the image writer and the attaching object receiving portion of a process cartridge.
Figure 9:
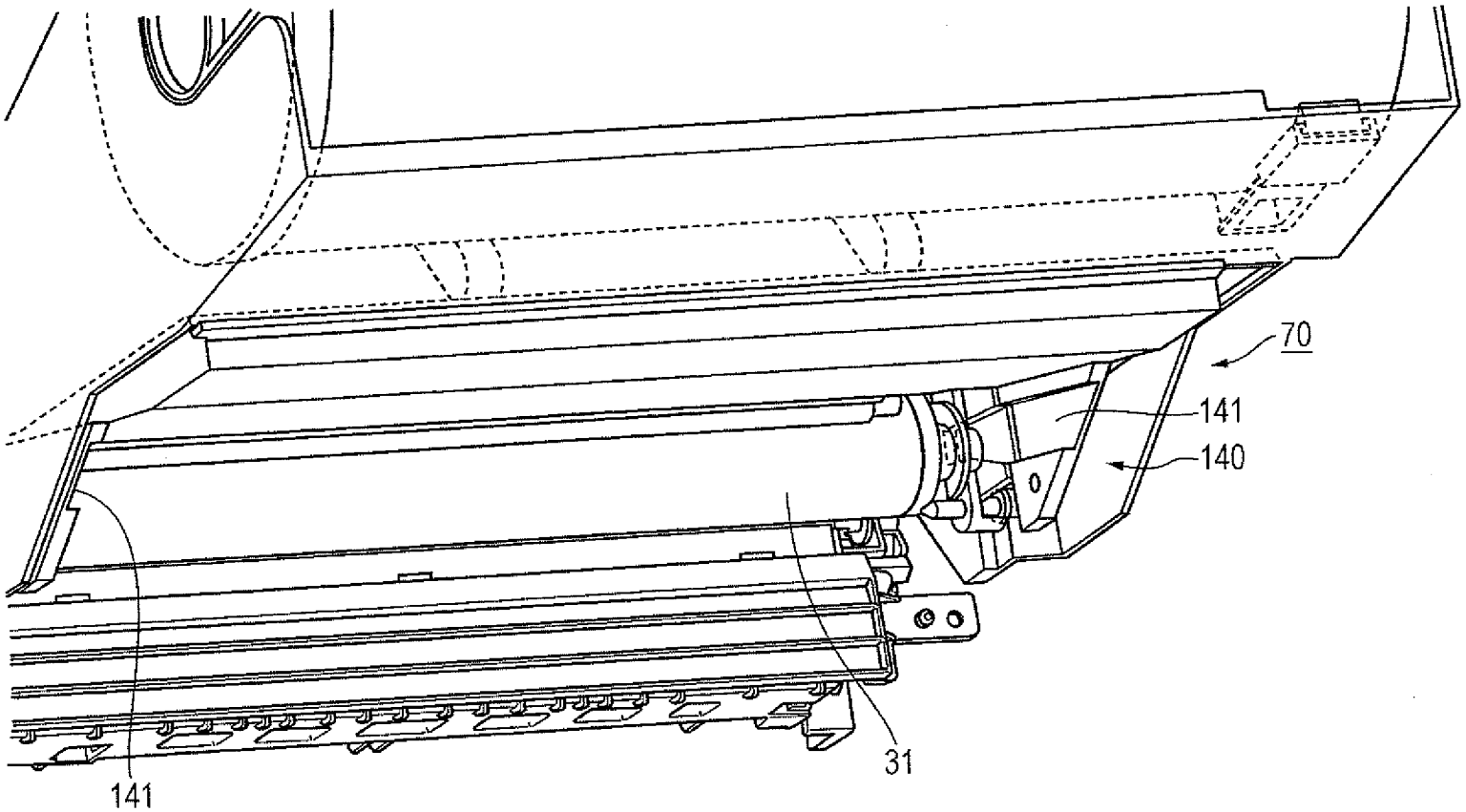
FIG. 9 illustrates a first guide mechanism provided in the attaching object receiving portion of the process cartridge.
Figure 10:
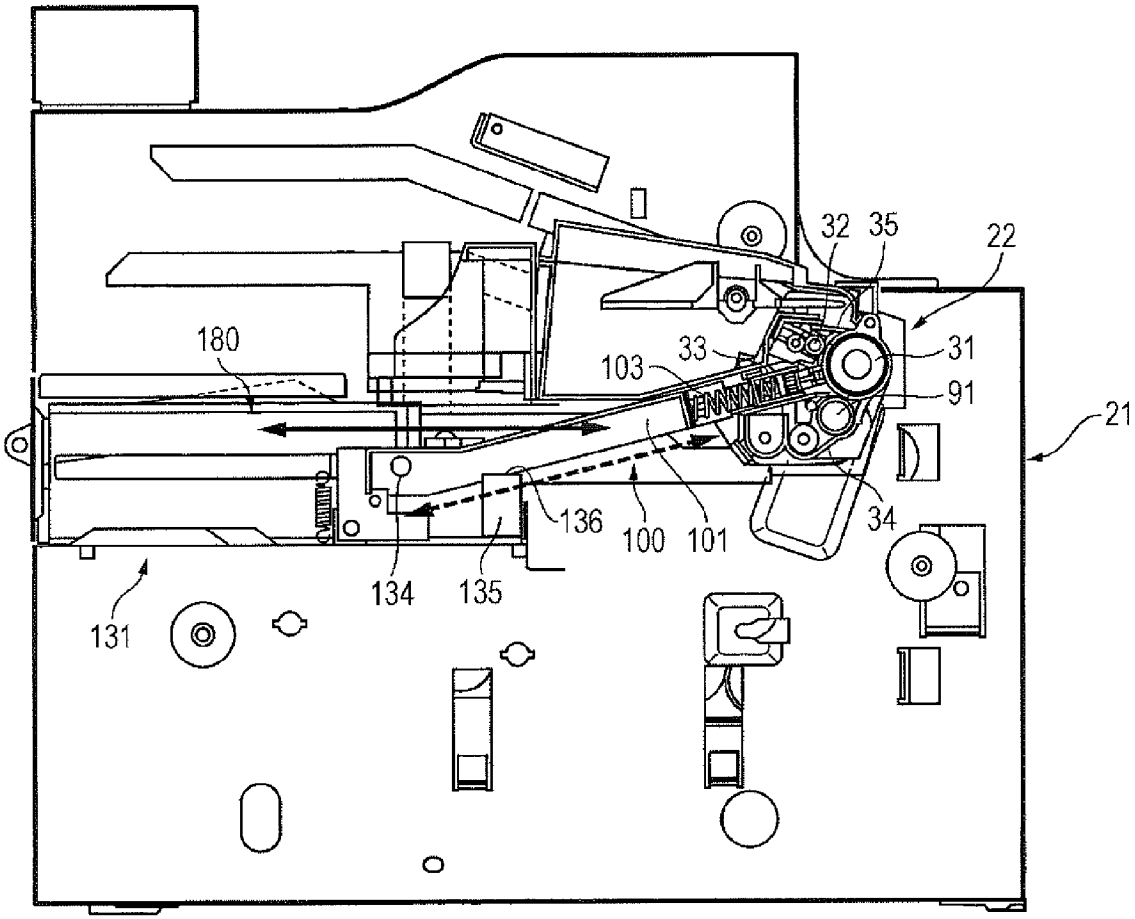
FIG. 10 illustrates the relative layout of the image writer and the process cartridge, and the direction in which the image writer and the guide mechanism for the image writer operate.
Figure 11:
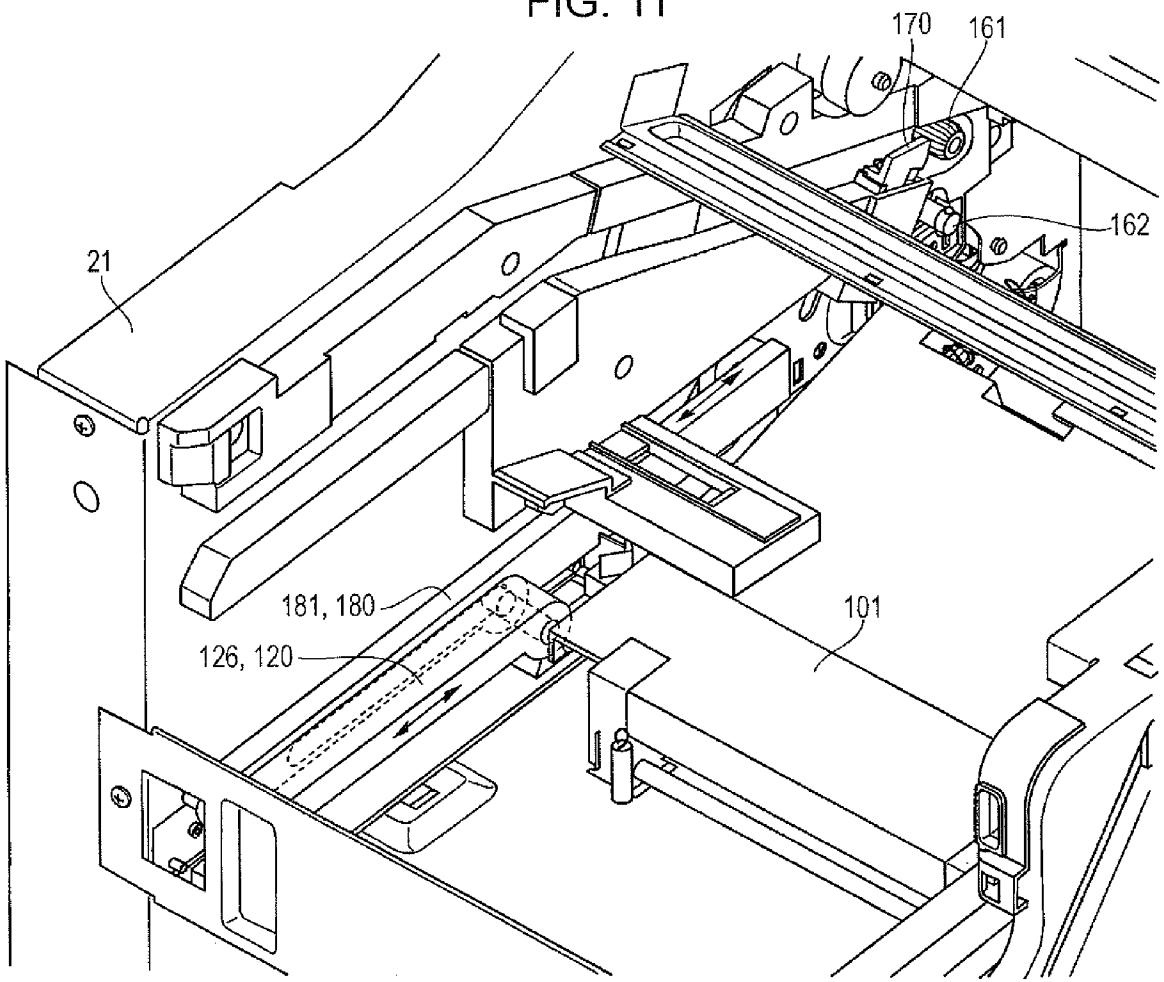
FIG. 11 is a perspective view, as seen from the opening and closing door side of an apparatus housing, of a guide mechanism for guiding a coupling component and a restricting component with respect to the process cartridge which is used in Exemplary Embodiment 1.
Figure 12:
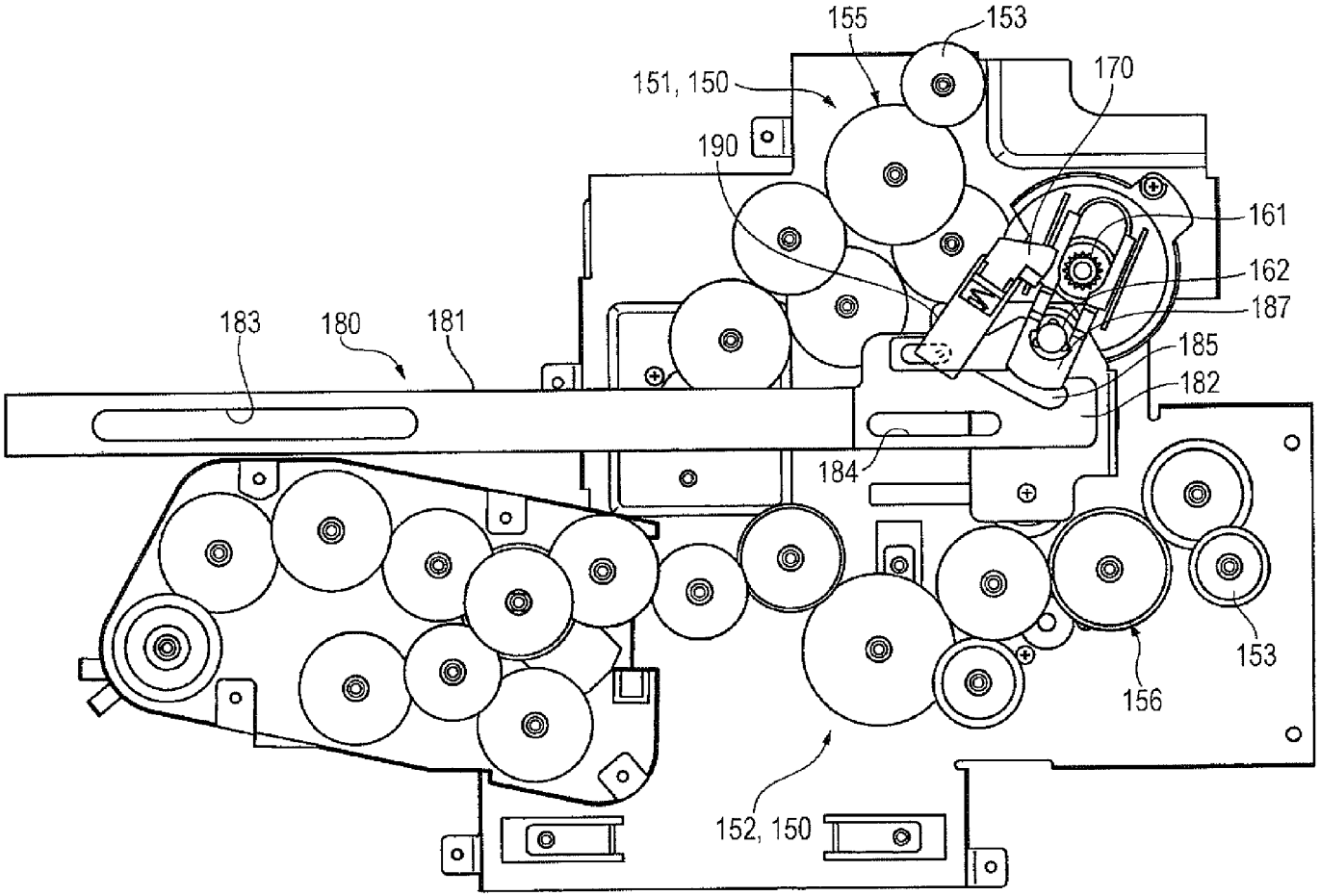
FIG. 12 is an explanatory view, as seen from the side, of the guide mechanism for the coupling component and the restricting component which is used in Exemplary Embodiment 1.

FIG. 3 illustrates a general configuration of an image forming apparatus according to Exemplary Embodiment 1.

In FIG. 3, an image forming apparatus 20 includes an image forming portion 22 disposed inside an apparatus housing 21, a recording medium supply device 24 disposed below the image forming portion 22, and a discharged recording medium receiver 26 provided in an upper part of the apparatus housing 21. The image forming portion 22 forms a single-color (for example, black) image. The recording medium supply device 24 receives a recording medium in a manner that allows supply of the recording medium. A recording medium on which an image has already been formed is discharged to and received in the discharged recording medium receiver 26. A recording medium supplied from the recording medium supply device 24 is discharged to the discharged recording medium receiver 26 via a transport path 25 extending in a substantially vertical direction.

In Exemplary Embodiment 1, as illustrated in FIG. 3, the image forming portion 22 forms an image by the electrophotographic system. The image forming portion 22 includes a photoconductor 31 having, for example, a drum-like shape, a charging unit 32 that electrically charges the photoconductor 31 in advance, an image writer 33 that writes an electrostatic latent image onto the photoconductor 31 charged by the charging unit 32, a developing unit 34 that develops the electrostatic latent image formed on the photoconductor 31 with toner of various colors, and a cleaning unit 35 that cleans toner remaining on the photoconductor 31.

The image writer 33 is implemented as a print head (abbreviated as LPH) in which LEDs as a light source are arranged at predetermined pixel pitches. The image writer 33 is disposed in a predetermined write position ST (see FIG. 15) opposed to the photoconductor 31.

In Exemplary Embodiment 1, a recording medium supplied from a feeder 61 of the recording medium supply device 24 is transported by a suitable number of transport rollers (not illustrated) provided in the transport path 25. After undergoing registration by a registration roller 62, the recording medium passes through a transfer part of a transfer unit 63. After an unfixed toner image is fixed onto the recording medium by a fixing unit 66 by, for example, application of heat and pressure, the resulting recording medium is discharged to the discharged recording medium receiver 26.

Process Cartridge

In Exemplary Embodiment 1, as illustrated in FIG. 3, the photoconductor 31 is implemented in a process cartridge 70 that is an attaching body integrated with the charging unit 32, the developing unit 34, and the cleaning unit 35. The process cartridge 70 is detachably attached to a cartridge receiving portion inside the apparatus housing 21, forming a major portion of the image forming portion 22.

In the present example, the process cartridge 70 includes a photoconductor assembly 71, a developing assembly 72, and a toner replenishment container 73. The photoconductor assembly 71 incorporates the photoconductor 31, the charging unit 32, and the cleaning unit 35. The developing assembly 72 is swingably coupled to the photoconductor assembly 71, and incorporates the developing unit 34. The toner replenishment container 73 replenishes the developing unit 34 with toner.

In the present example, as illustrated in FIG. 3, an opening and closing door 27 is provided on the front side (corresponding to the left side in FIG. 3) of the apparatus housing 21. The opening and closing door 27 opens and closes with the lower edge of its opening as a support shaft 27*a*. The process cartridge 70 is detachably attached inside the apparatus housing 21 by opening the opening and closing door 27.

<Photoconductor Assembly>

The photoconductor assembly 71 has a receiving container in which the photoconductor 31, the charging unit 32, and the cleaning unit 35 are received. Opposite end portions of the rotating shaft of the photoconductor 31 are rotatably supported on the opposite ends of the receiving container. Upon attaching the process cartridge 70, one end of the rotating shaft of the photoconductor 31 is drivingly coupled to a drive transmission system via a coupling (coupling component) (not illustrated).

The charging unit 32 has a charging container portion provided in a part of the receiving container. A charging roller and a cleaning roller are provided inside the charging container portion. The charging roller is in contact with or close proximity to the surface of the photoconductor 31. The cleaning roller cleans the charging roller.

Further, the cleaning unit 35 has a cleaning container portion provided in a part of the receiving container. The opening edge of this cleaning container portion is provided with a plate-like cleaning member that scrapes off toner remaining on the surface of the photoconductor 31.

<Developing Assembly>

As illustrated in FIG. 3, a developing assembly 72 has a developing container that is open toward the photoconductor 31 and receives a two-component developer including toner and carrier. A developing roller 91, which carries and transports the developer, is disposed in a location facing the opening of the developing container. A pair of developer agitating members 92 (which have, for example, spiral vanes attached around the rotating shaft) is disposed on the back side of the developing roller 91 inside the developing container. Further, a layer-thickness regulating member (for example, a layer-thickness regulating roller) is provided upstream in the rotational direction of the developing part of the developing roller 91. The layer-thickness regulating member regulates the layer thickness of developer carried on the developing roller 91.

In the present example, upon attaching the process cartridge 70, one end of the rotating shaft of the developing roller 91 is drivingly coupled to the drive transmission system via a coupling (coupling component) (not illustrated).

Guide Mechanism for Image Writer

In Exemplary Embodiment 1, as illustrated in FIG. 3, the image writer (LPH in the present example) 33 is held by a holding mechanism 100. The image writer 33 is guided along a predetermined guide path by a guide mechanism 110 via the holding mechanism 100.

<Holding Mechanism>

As illustrated in FIGS. 3 to 8 and FIG. 14, the holding mechanism 100 for the image writer 33 has a holder 101 formed by a substantially rectangular plate member that extends in the direction of movement of the image writer 33. An end portion on the image writer 33 side of the holder 101 is provided with an embracing portion 102. The embracing portion 102 embraces the image writer 33 in a manner that allows advancing and retracting movement while positioning the opposite longitudinal ends of the image writer 33 in place. In addition, a suitable number of urging springs 103 are provided on the image writer 33 side of the holder 101, thereby urging the image writer 33 embraced by the embracing portion 102 away from the holder 101.

In the present example, a pivot point is provided in the proximal end portion of the holder 101 located opposite to the embracing portion 102. The holder 101 is supported so as to be swingable about the pivot point.

A flange-like piece 105 is provided in a part of the holder 101 which is located on either side of the width direction excluding the embracing portion 102. The flange-like piece 105 projects laterally in a flange-like fashion.

<Interlock Mechanism>

In the present example, the opening and closing door 27 opens and closes with the support shaft 27*a* located at the lower edge of its opening as the center of rotation. An interlock mechanism 120 is provided between the opening and closing door 27 and the holding mechanism 100 for the image writer 33.

The interlock mechanism 120 has a pair of first interlock arms 121 that is rod-shaped and operates in conjunction with opening and closing of the opening and closing door 27. Hook pins 122 and 123 are provided integrally at positions near one end and the other end, respectively, of the first interlock arm 121. A pair of support pieces 124 projects from the inner surface of the opening and closing door 27. The support piece 124 is provided with a support hole 125 having a circular shape. The hook pin 122 provided at one end of the first interlock arm 121 is rotatably supported in the support hole 125.

Further, the interlock mechanism 120 has a pair of second interlock arms 126 provided to the apparatus housing 21. The second interlock arm 126, which is located at a position corresponding to the other end of the pair of first interlock arms 121, is formed by a plate member that extends in a substantially horizontal direction. A support groove 127, which extends in the longitudinal direction of the second interlock arm 126, is formed on the opening and closing door 27 side of the second interlock arm 126. The hook pin 123 provided near the other end of the first interlock arm 121 is slidably fitted in the support groove 127 of the second interlock arm 126.

A support shaft 128 is passed between end portions located on the side of the second interlock arms 126 away from the opening and closing door 27. The proximal end portion located on the side of the holder 101 away the image writer 33 is rotatably supported on the support shaft 128. Accordingly, the holder 101 holds the image writer 33 in a manner that allows the image writer 33 to swing about the support shaft 128 as a pivot point.

<Overview of Guide Mechanism>

At the time of opening the opening and closing door 27 to attach or detach the process cartridge 70, the guide mechanism 110 in the present example guides the image writer 33 in such a way that the image writer 33 located in the write position ST retracts to the retracted position RT located outside the space necessary for attaching or detaching the process cartridge 70, thereby preventing the process cartridge 70 and the image writer 33 from interfering with each other at the time of attaching or detaching the process cartridge 70.

Further, the guide mechanism 110 is required to guide the image writer 33 located in the retracted position RT to the write position ST, upon closing the opening and closing door 27 from the open position to the close position after the process cartridge 70 is attached inside the apparatus housing 21.

An example of the guide mechanism 110 will be described below in detail.

In the present example, the guide mechanism 110 includes a first guide mechanism 111 that guides the image writer 33 with respect to the process cartridge 70 attached inside the apparatus housing 21, and a second guide mechanism 112 that guides the image writer 33 with respect to the apparatus housing 21.

First, before describing the first guide mechanism 111, the second guide mechanism 112 will be described.

<Second Guide Mechanism>

As illustrated in FIGS. 3 to 8, the second guide mechanism 112 is configured as follows. A pair of guide rails 131 extending in a substantially horizontal direction is installed in a stationary manner outside the width direction of the pair of second interlock arms 126 and the holder 101 of the image writer 33. The mutually opposing parts of the pair of guide rails 131 are provided with a recess 132 in which the second interlock arm 126 is able to move in a substantially horizontal direction. The vertical wall portion of the recess 132 is provided with a guide groove 133 that extends in a substantially horizontal direction. A guide pin 134 that is coaxial with, for example, the support shaft 128 projects outward from the end portion located on the side of the second interlock arm 126 away from the opening and closing door 27. The guide pin 134 is fitted in the guide groove 133 of the guide rail 131 in a manner that allows the guide pin 134 to slide along the guide groove 133.

In the present example, the guide pin 134 is slidably fitted in the guide groove 133 of the pair of guide rails 131. However, this is not to be construed restrictively. For example, in an alternative configuration, a pinion (not illustrated) is rotatably attached to the guide pin 134, and a rack having meshing teeth formed at predetermined pitches is disposed along the guide groove 133. By bringing the pinion into meshing engagement with the rack, the pair of guide pins 134 is moved by a predetermined amount, thereby regulating the amount of movement on either side of the width direction of the holder 101.

Further, in the present example, the flange-like piece 105 of the holder 101 is arranged inside the recess 132 of the guide rail 131 so as to be movable in a non-contact state. A guide base 135 is provided in a part of the recess 132 of the guide rail 131 which is located on the image writer 33 side. The top portion of the guide base 135 is provided with a guide surface 136 that extends in a substantially horizontal direction. A rib 137 is provided on the lower surface of either side portion of the width direction of the holder 101. The rib 137 is an overhanging member that extends along the longitudinal direction of the flange-like piece 105 and overhangs downward. The rib 137 has a first inclined portion **138*a* and a second inclined portion 138*b* that form a chevron shape with respect to the longitudinal direction of the flange-like piece 105**.

In the present example, the rib 137 of the holder 101 is arranged so as to be movable in a non-contact state in a part of the recess 132 of the guide rail 131 excluding the guide base 135. When the rib 137 of the holder 101 moves toward the guide base 135 and reaches the guide base 135, the first inclined portion **138*a* of the rib 137 of the holder 101 comes into contact with the guide surface 136. At this time, the holder 101 changes its orientation about the pivot point along the first inclined portion 138*a* of the rib 137, thereby changing the orientation and position of the image writer 33**.

<First Guide Mechanism>

In the present example, as illustrated in FIGS. 4 to 9, the process cartridge 70 has an attaching object receiving portion 140 to which the image writer 33 may be attached. The first guide mechanism 111 has a guide groove 141 and a guided pin 142. The guide groove 141, which is formed on either side in the width direction of the attaching object receiving portion 140 of the process cartridge 70, extends linearly toward the write position ST of the image writer 33. The guided pin 142 is provided on either side in the width direction of the embracing portion 102 of the holder 101 of the image writer 33 so as to project outward. By slidably fitting the guided pin 142 in the guide groove 141 of the process cartridge 70, the image writer 33 is guided with respect to the attaching object receiving portion 140 of the process cartridge 70.

In the present example, guiding by the second guide mechanism 112 is not performed while guiding by the first guide mechanism 111 is performed. Specifically, while guiding is performed by the first guide mechanism 111, in the second guide mechanism 112, the second inclined portion **138*b* of the rib 137 of the holder 101 is arranged in a location opposed to the guide surface 136 so that the second inclined portion 138*b* and the guide surface 136** are not in contact with each other.

The image writer 33 is guided to the write position ST after being guided by the first guide mechanism 111. At this time, in the present example, the image writer 33 is positioned in a state in which the image writer 33 is in contact with a positioning portion (not illustrated) previously provided in the attaching object receiving portion 140 and is urged by the urging spring 103.

Guide Mechanism for Coupling Component and Restricting Component

<Coupling Component and Restricting Component>

In Exemplary Embodiment 1, as illustrated in FIGS. 8 to 14, a drive transmission system 150 is provided on one side of the longitudinal direction of the process cartridge 70 of the apparatus housing 21. The drive transmission system 150 drives components such as the photoconductor 31 and the developing roller 91 of the developing unit 34.

In the illustrated example, the drive transmission system 150 includes a drive transmission system for photoconductor 151 that transmits a driving force to the photoconductor 31, and a drive transmission system for developing unit 152 that transmits a driving force to the developing roller 91 of the developing unit 34. The drive transmission system for photoconductor 151 and the drive transmission system for developing unit 152 are configured to transmit the driving force from a drive motor 153 (see FIG. 12) via a drive transmission gear train 155 and a drive transmission gear train 156, respectively.

The drive transmission system for photoconductor 151 is coupled to the support shaft of the photoconductor 31 via a coupling component (a coupling in the present example) 161, thereby transmitting a drive force to the photoconductor 31.

The drive transmission system for developing unit 152 is coupled to the support shaft of the developing roller 91 of the developing unit 34 via a coupling component (a coupling in the present example) 162, thereby transmitting a drive force to the developing roller 91. In the present example, drive is transmitted to the developer agitating member 92 of the developing unit 34 in response to the transmission of a drive force to the developing roller 91.

A pair of restricting components (restricting plates in the present example) 170 is provided on either axial side of the photoconductor 31 of the process cartridge 70, thereby restricting dislodging of the photoconductor 31 in the axial direction.

In Exemplary Embodiment 1, at the time of attaching or detaching the process cartridge 70, the coupling component 161 or 162 is required to retract to a retracted position RT located outside a coupling position CS with the shaft portion of the photoconductor 31 or the developing roller 91. Further, the restricting component 170 is required to retract to a retracted position RT located outside a restricting position KS that restricts dislodging of the photoconductor 31 in the axial direction.

The retracted position RT of the coupling component 161 or 162 may be set to any such position in which the shaft portion of the photoconductor 31 or the developing roller 91 does not interfere with the coupling component 161 or 162 at the time of attaching or detaching the process cartridge 70. Accordingly, the retracted position RT of the coupling component 161 or 162 may not necessarily be set outside the space for attaching and detaching the process cartridge 70. Likewise, the retracted position RT of the restricting component 170 may be set to any such position in which the axial end portion of the photoconductor 31 does not interfere with the restricting component 170 at the time of attaching or detaching the process cartridge 70.

Accordingly, the retracted position RT of the restricting component 170 may not necessarily be set outside the space for attaching and detaching the process cartridge 70.

Therefore, the span between the coupling position CS and the retracted position RT of the coupling component 161 or 162, and the span between the restricting position KS and the retracted position RT of the restricting component 170 may be both set smaller than the span between the write position ST and the retracted position RT of the image writer 33.

<Overview of Guide Mechanism for Coupling Component and Restricting Component>

In Exemplary Embodiment 1, the coupling component 161 or 162, and the restricting component 170 are each guided along a predetermined guide path via a guide mechanism 180 that operates in conjunction with opening and closing of the opening and closing door 27.

As illustrated in FIGS. 10 to 14, the guide mechanism 180 in the present example, which is provided on either axial side of the photoconductor 31 of the process cartridge 70, is configured differently on either side.

Figure 13:
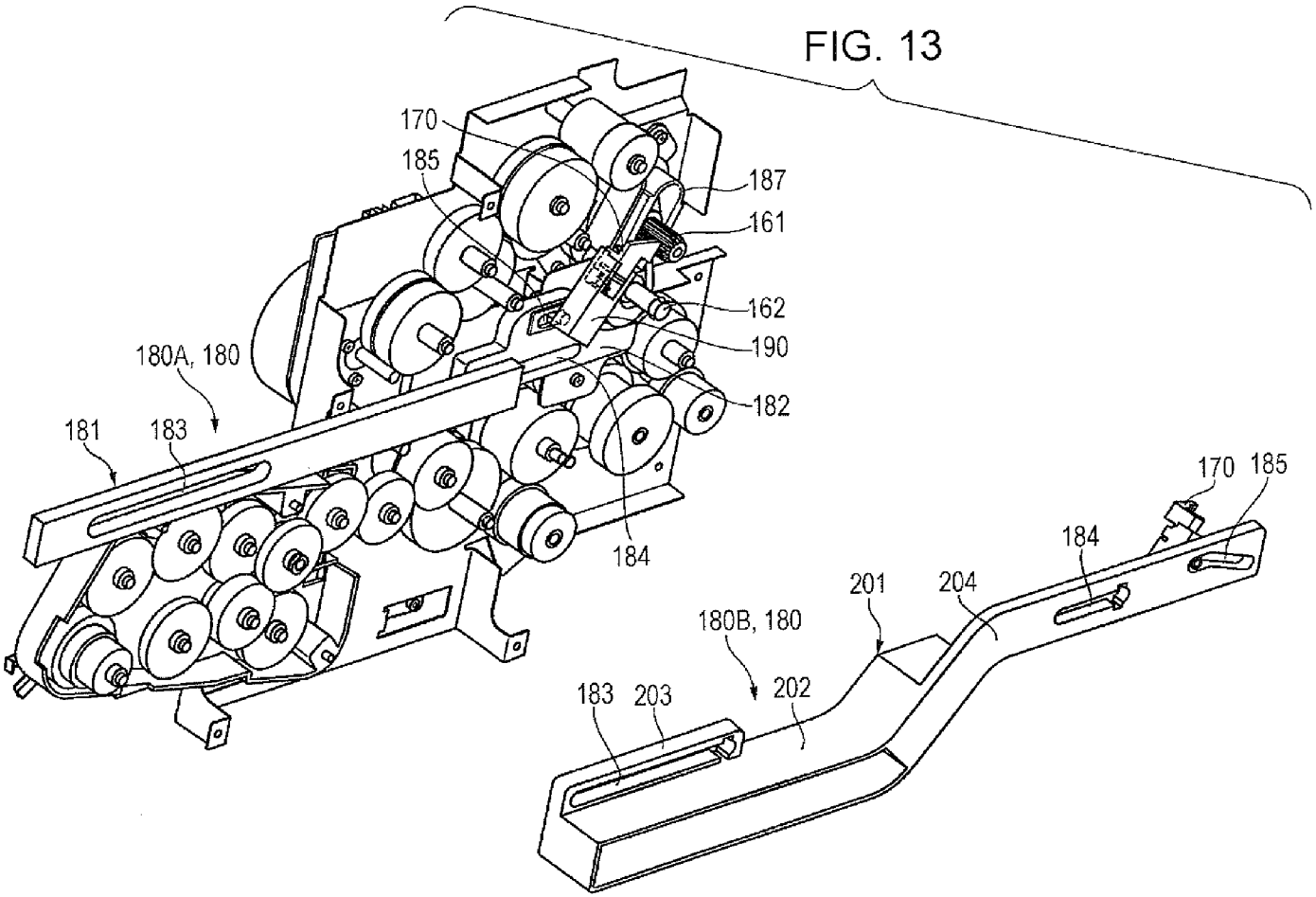
FIG. 13 is a perspective view of the guide mechanism for the coupling component and the restricting component which is used in Exemplary Embodiment 1.
Figure 14:
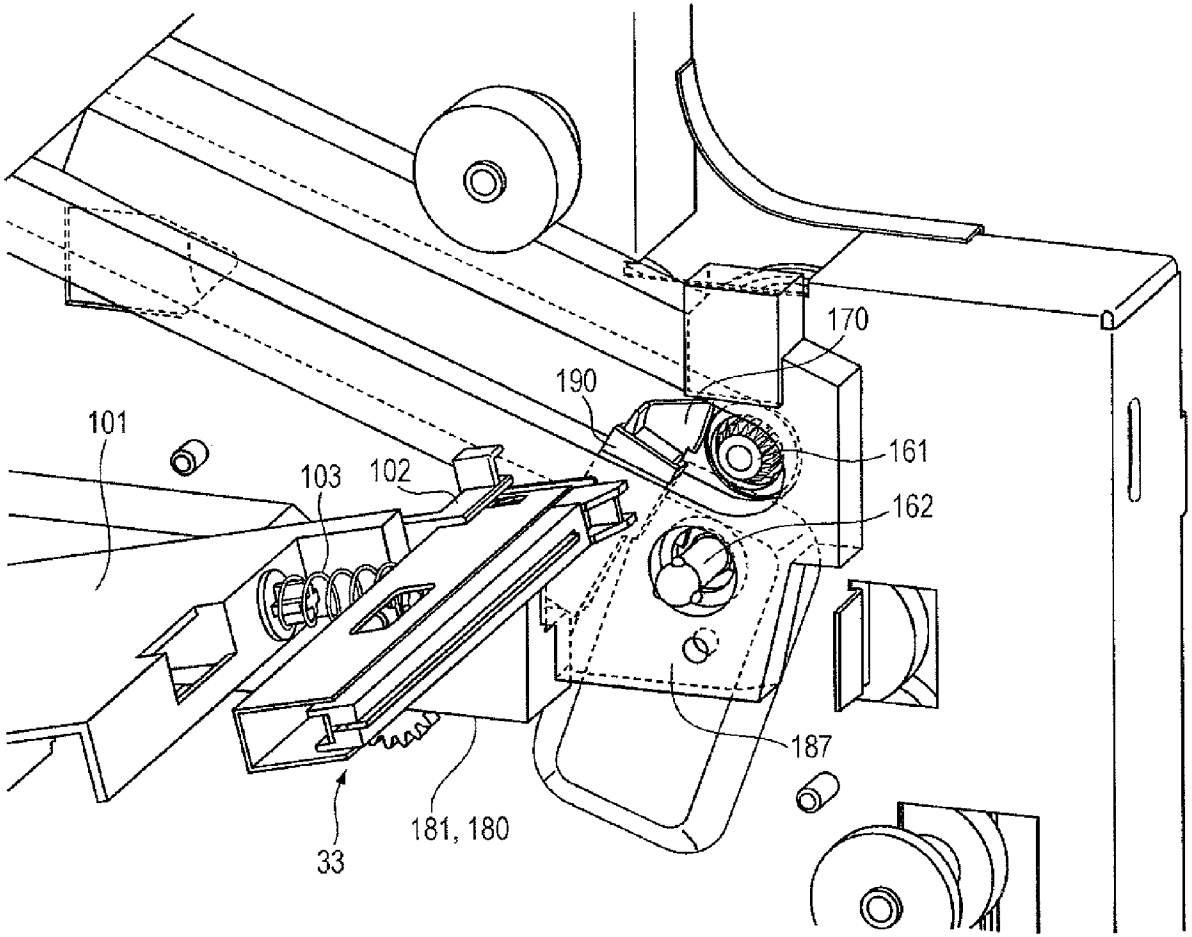
FIG. 14 is an explanatory view of a major portion, illustrating the vicinity of the image writer, the coupling component, and the restricting component used in Exemplary Embodiment 1.

That is, as illustrated in FIG. 13, the drive transmission system 150 is provided on one side of the axial direction of the photoconductor 31 of the process cartridge 70 but not on the other side. Accordingly, a drive-side guide mechanism 180A including the drive transmission system 150 has the function of guiding the coupling component 161 or 162 and the restricting component 170, whereas a non-drive-side guide mechanism 180B that does not include the drive transmission system 150 is only required to have the function of guiding the restricting component 170.

An example of the guide mechanism 180 will be described below in detail.

<Drive-Side Guide Mechanism>

First, the drive-side guide mechanism 180A will be described.

In the present example, as illustrated in FIG. 13, the drive-side guide mechanism 180A has a link arm 181 that extends in a substantially horizontal direction. The link arm 181 is located outside the second interlock arm 126 of the interlock mechanism 120 (see FIG. 4). The link arm 181, which is set longer than the second interlock arm 126, extends to the vicinity of the photoconductor 31 of the process cartridge 70. The link arm 181 has an overhanging portion 182, in which the part of the link arm 181 corresponding to the vicinity of the photoconductor 31 of the process cartridge 70 overhangs further outward in a stepped configuration in comparison to the other part.

The link arm 181 has a first guide groove 183, a second guide groove 184, and a third guide groove 185. The first guide groove 183, which is in the shape of an elongated hole, is located in a portion of the link arm 181 near the opening and closing door 27 and extends in a substantially horizontal direction. The second guide groove 184, which is in the shape of an elongated hole, is provided in the overhanging portion 182 located in the vicinity of the photoconductor 31 and extends in a substantially horizontal direction. The third guide groove 185, which is provided in a part of the overhanging portion 182 located above the second guide groove 184, is inclined obliquely downward toward its end portion.

Further, in the present example, the guide pin 134 of the second interlock arm 126 penetrates the guide groove 133 of the guide rail 131, and further slidably fits in the first guide groove 183 of the link arm 181. In the present example, the guide pin 134 of the second interlock arm 126 is used for both the guide groove 133 and the first guide groove 183. However, it is of course possible not to use the guide pin 134 also as a guide pin that fits in the first guide groove 183 of the link arm 181 but provide another guide pin as such a guide pin.

A positioning pin (not illustrated), which is provided to the frame of the apparatus housing 21 or a bracket secured to this frame, slidably fits in the second guide groove 184 of the link arm 181, thus keeping the advancing and retracting direction of the link arm 181 substantially horizontal.

Further, in Exemplary Embodiment 1, the coupling component 161 or 162 is held by a first link holder 187 having a U-shaped stepped holding portion. A hook pin 188 (see FIG. 21A) is provided in a part of the first link holder 187. The hook pin 188 slidably fits in the third guide groove 185.

In substantially the same manner as the coupling component 161 or 162, the restricting component 170 is held by a second link holder 190. A hook pin 191 (see FIG. 21A) is provided in a part of the second link holder 190. The hook pin 191 slidably fits in a part of the third guide groove 185 different from where the hook pin 188 is located.

<Non-Drive-Side Guide Mechanism>

Next, the non-drive-side guide mechanism 180B will be described.

In the present example, as illustrated in FIG. 13, the non-drive-side guide mechanism 180E has a link arm 201 that extends in a substantially horizontal direction. The link arm 201 is located outside the second interlock arm 126 of the interlock mechanism 120 (see FIG. 4). The link arm 201 is set longer than the second interlock arm 126 and extends to the vicinity of the photoconductor 31 of the process cartridge 70. The link arm 201 has a shape different from the link arm 181.

In the present example, the link arm 201 has an arm body 202 in a part of the link arm 201 corresponding to the second interlock arm 126. A projection 203 is provided at the inner upper edge of the arm body 202. Further, the link arm 201 has an overhanging portion 204 located in a part of the link arm 201 from the arm body 202 to a position corresponding to the vicinity of the photoconductor 31 of the process cartridge 70. The overhanging portion 204 overhangs further outward with respect to the projection 203 in a stepped configuration.

In substantially the same manner as the link arm 181, the first guide groove 183 is formed in the projection 203 of the link arm 201, and the second guide groove 184 and the third guide groove 185 are formed in the overhanging portion 204. In this regard, the third guide groove 185 of the link arm 201 is used to adjust the path of advancing and retracting movement of the restricting component 170. Because the path of advancing and retracting movement of each of the coupling component 161 or 162 and the restricting component 170 is to be taken into consideration for the third guide groove 185 of the link arm 181, the length of the third guide groove 185 in the link arm 201 is set shorter than that in the link arm 181.

Further, the guide pin 134 of the second interlock arm 126, a positioning pin 186 securely provided to the frame or bracket of the apparatus housing 21, and the hook pin 191 of the second link holder 190 that holds the restricting component (restricting plate in the present example) 170 slidably fit in the first guide groove 183, the second guide groove 184, and the third guide groove 185, respectively, of the link arm 201.

<Dimension Settings of Guide Mechanism for Coupling Component and Restricting Component>

In the present example, s, s1, and s2 are set as follows in the link arm 181 and the link arm 201, where s1 represents the length of the first guide groove 183, s2 represents the length of the second guide groove 184, and s represents the amount of movement along a substantially horizontal direction of the second interlock arm 126.

$$s1>s2 \quad (1)$$

$$s\approx=s1+s2 \quad (2)$$

Figure 21A:
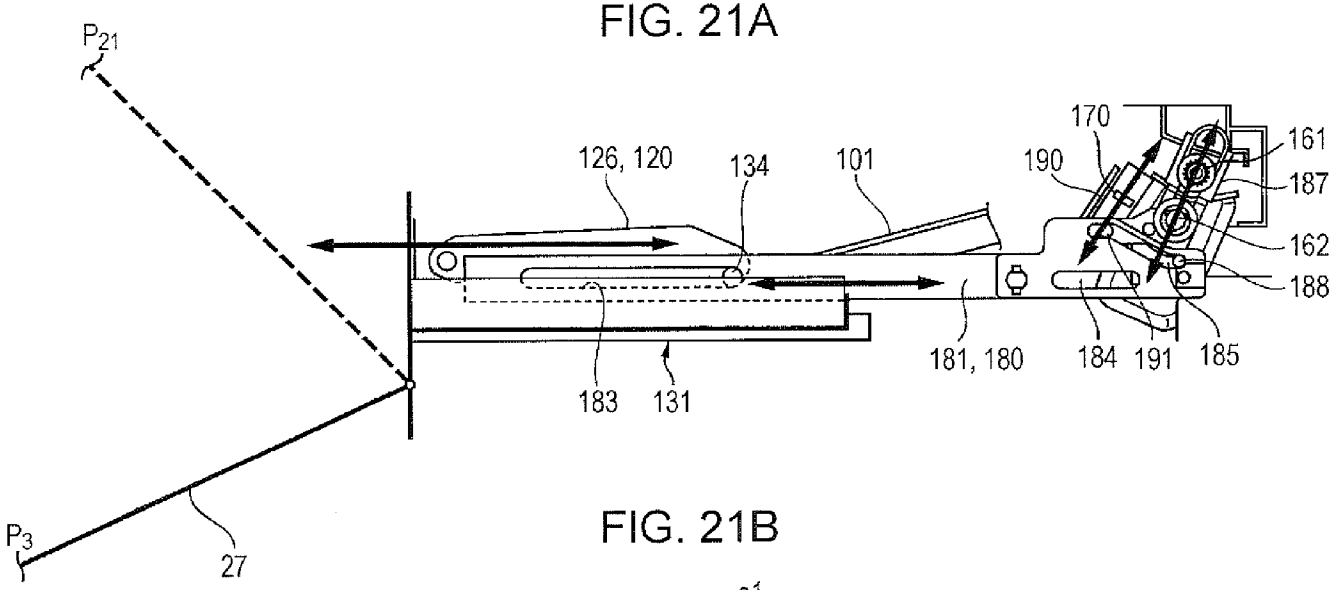
FIG. 21A illustrates guiding of the coupling component and the restricting component associated with opening and closing of the opening and closing door.
Figure 21B:
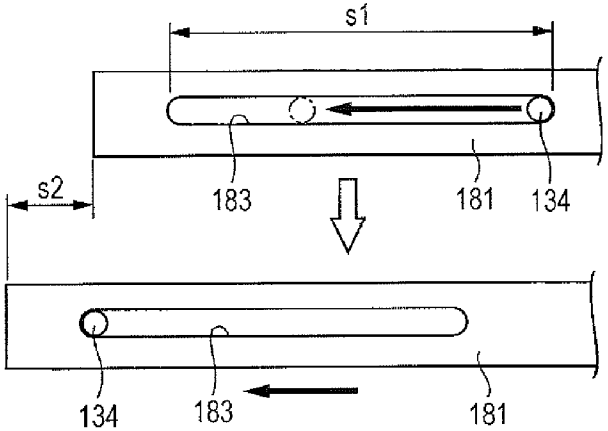
FIG. 21B illustrates an operational process, associated with opening and closing of the opening and closing door, of the guide mechanism for the coupling component and the restricting component.

With the above dimensional relationship, when the opening and closing door 27 is located in the close position $P_1$ (see FIG. 15), for example, as illustrated in FIGS. 21A and 21B, the guide pin 134 of the second interlock arm 126 is at the end edge of the first guide groove 183 of each of the link arms 181 and 201 which is located away from the opening and closing door 27.

At this time, the positioning pin (not illustrated) is arranged at the end edge of the second guide groove 184 which is located near the opening and closing door 27.

Further, as illustrated in FIGS. 16, 17, and 21A and 21B, upon gradually opening the opening and closing door 27 from the close position $P_1$ toward the intermediate open positions $P_{21}$ and $P_{22}$, the guide pin 134 of the second interlock arm 126 of the interlock mechanism 120 moves by the distance s1, and reaches the end edge on the opening and closing door 27 side of the first guide groove 183 of each of the link arms 181 and 201. In the meantime, in the first guide groove 183 of each of the link arms 181 and 201, the guide pin 134 of the second interlock arm 126 of the interlock mechanism 120 slides along the first guide groove 183, and hence the operational force associated with opening and closing of the opening and closing door 27 is not transmitted to the link arms 181 and 201. Therefore, in the second guide groove 184 of each of the link arms 181 and 201, the position of the positioning pin 186 is the same as that when the opening and closing door 27 is located in the close position $P_1$.

Figure 18:
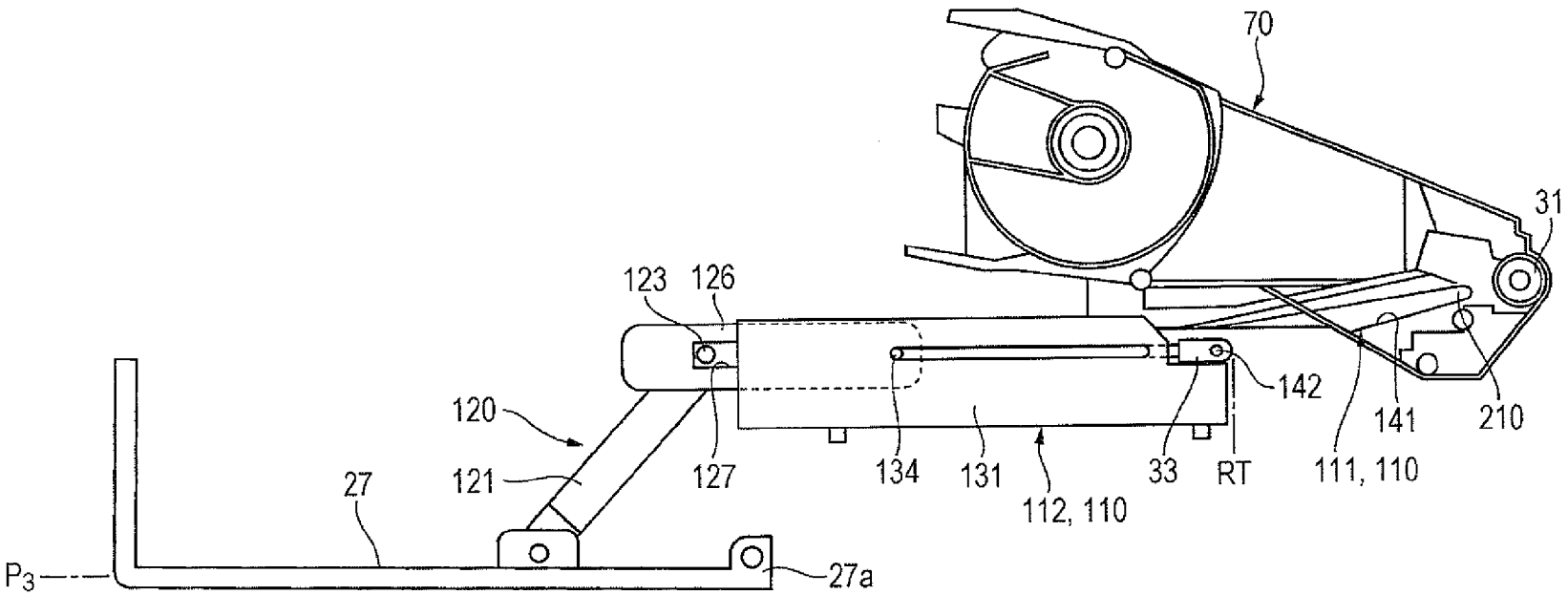
FIG. 18 illustrates an operational process (4) of the guide mechanism associated with opening of the opening and closing door.

Thereafter, upon opening the opening and closing door 27 to the open position $P_3$ as illustrated in FIG. 18 and FIGS. 21A and 21B, the link arms 181 and 201 move by the distance s2. In the meantime, the positioning pin 186 moves relatively by the distance s2 in the second guide groove 184, and thus the link arms 181 and 201 move while keeping their substantially horizontal orientation.

When the link arms 181 and 201 move in this state, the hook pin 191 of each of the first and second link holders 187 and 190 moves obliquely downward along the slope of the third guide groove 185. As a result, the first and second link holders 187 and 190 retract from the coupling position CS and the restricting position KS, respectively, causing the coupling component 161 or 162 and the restricting component 170 to move to the retracted position RT.

Operation of Image Forming Apparatus

First, operation of the image forming apparatus according to Exemplary Embodiment 1 will be described.

Now, when the image forming apparatus 20 is in a state capable of image formation, as illustrated in FIG. 3, the process cartridge 70 of the image forming portion 22 is attached to the cartridge receiving portion (not illustrated) inside the apparatus housing 21.

Upon closing the opening and closing door 27 with the process cartridge 70 being attached to the cartridge receiving portion, the image writer 33 is positioned in a positioning portion previously provided in the process cartridge 70, and the image writer 33 is set to a predetermined write position ST in relation to the photoconductor 31.

Further, the coupling component 161 or 162 is set in the coupling position CS, and the restricting component 170 is set in the restricting position KS. The driving force from the drive transmission system 150 is transmitted to components such as the photoconductor 31 and the developing unit 34 of the process cartridge 70.

In this state, after a single-color (for example, black) electrostatic latent image is written onto the photoconductor 31 of the image forming portion 22 by the image writer 33, a single-color toner image is formed by the developing unit 34, and the toner image is transferred to a recording medium via the transfer unit 62. Thereafter, the resulting recording medium is discharged to the discharged recording medium receiver 26 via the fixing unit 66.

Replacement of Process Cartridge

Next, a process of replacing the process cartridge 70 incorporated into the image forming apparatus will be described.

The process cartridge 70 may be replaced as follows. First, the opening and closing door 27 of the apparatus housing 21 is opened. Then, the process cartridge 70 that is currently attached is removed from the opening of the opening and closing door 27.

At this time, in Exemplary Embodiment 1, by opening the opening and closing door 27 from the close position $P_1$ to the open position $P_3$, the image writer 33 is guided by the guide mechanism 110 (the first guide mechanism 111 and the second guide mechanism 112) from the write position ST to the retracted position RT.

Further, in the present example, the coupling component 161 or 162 and the restricting component 170 are guided by the guide mechanism 180 to the retracted position RT from the coupling position CS and the restricting position KS, respectively.

In this state, the image writer 33 retracts to the retracted position RT located outside the space for attaching and detaching the process cartridge 70, and the coupling component 161 or 162 and the restricting component 170 are guided to the retracted position RT retracted from the coupling position CS and the restricting position KS, respectively. Thus, the coupling due to the coupling component 161 or 162 is released, and the restriction of dislodging of the photoconductor 31 by the restricting component 170 is released.

Therefore, at the time of attaching or detaching the process cartridge 70, the image writer 33, the coupling component 161 or 162, and the restricting component 170 do not interfere with the process cartridge 70.

<Guiding of Image Writer>

Now, how the guide mechanism 110 guides the image writer 33 will be described.

Figure 15:
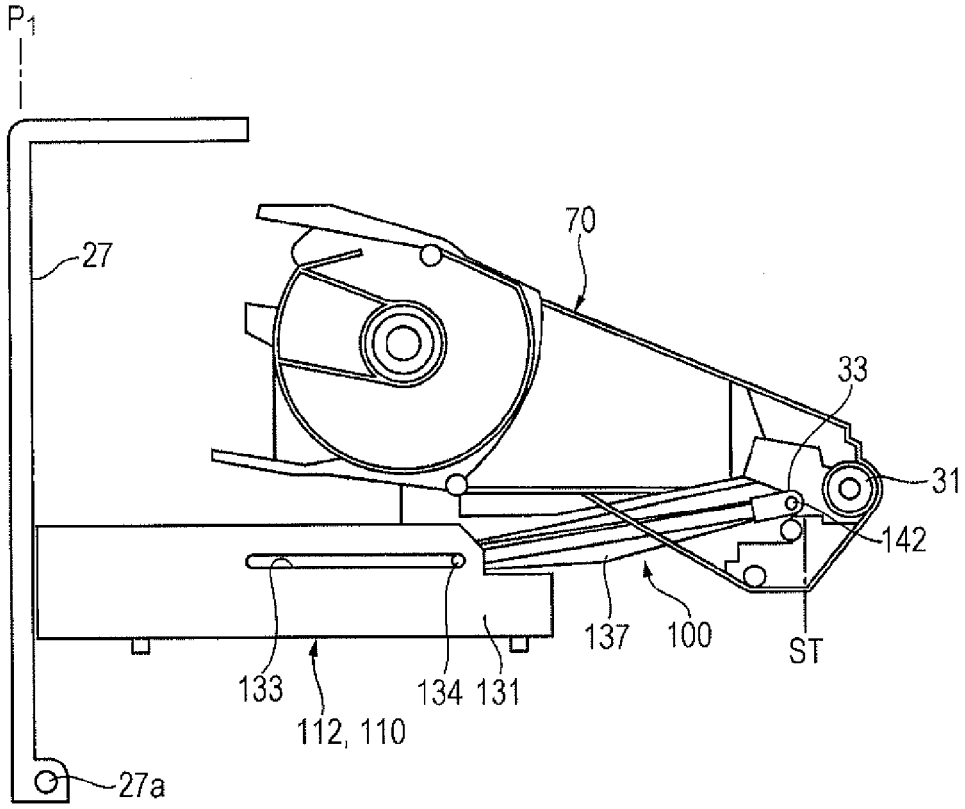
FIG. 15 illustrates an operational process (1), associated with opening of the opening and closing door, of the guide mechanism for the image writer which is used in Exemplary Embodiment 1.

When the opening and closing door 27 is located in the close position $P_1$ as illustrated in FIG. 15, the process cartridge 70 is attached to the cartridge receiving portion (not illustrated) inside the apparatus housing 21. At this time, the image writer 33 is positioned in a positioning portion 210 (see FIG. 20) previously provided in the process cartridge 70, and is arranged in a predetermined write position ST with respect to the photoconductor 31.

Figure 16:
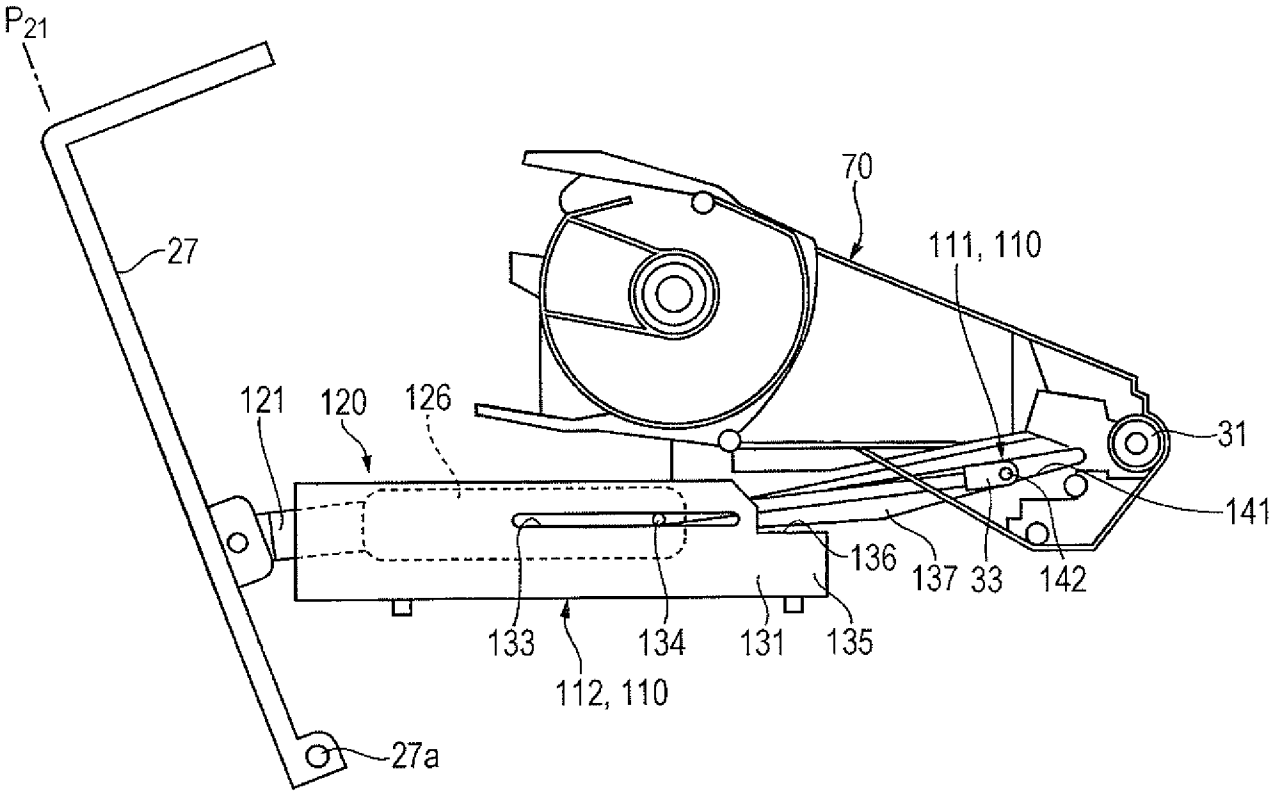
FIG. 16 illustrates an operational process (2) of the guide mechanism associated with opening of the opening and closing door.

If the opening and closing door 27 is started to open in this state and moved to the intermediate open position $P_{21}$ as illustrated in FIG. 16, the opening action of the opening and closing door 27 is transmitted to the guide mechanism 110 via the interlock mechanism 120.

At this time, in the interlock mechanism 120, the first interlock arm 121 is drawn out as the opening and closing door 27 is opened. Accordingly, the second interlock arm 126 is drawn out toward the opening and closing door 27. At this stage, since the holder 101 of the image writer 33 is coupled to the second interlock arm 126 via the support shaft 128, as the second interlock arm 126 is drawn out, the holder 101 is drawn out while being able to swing about the support shaft 128 as a pivot point. Accordingly, as the holder 101 is drawn out, the image writer 33 moves away from the write position ST.

In the second guide mechanism 112, as the holder 101 is drawn out, the guide pin 134, which is provided coaxially with the support shaft 128 of the holder 101, moves along the guide groove 133 of the guide rail 131.

In this state, in the first guide mechanism 111, the guided pin 142 provided in the embracing portion 102 of the image writer 33 moves linearly along the guide groove 141 of the process cartridge 70 as the holder 101 is drawn out. Therefore, the holder 101 and the image writer 33 move away from the write position ST while changing to such an orientation that linearly connects the guide pin 134 and the guided pin 142. In the meantime, in the second guide mechanism 112, the second inclined portion **138*b* of the rib 137 of the holder 101 is arranged in a location corresponding to the guide surface 136 of the guide base 135. At this time, the second inclined portion 138*b* of the rib 137 maintains a non-contact state with respect to the guide surface 136 of the guide base 135**.

Figure 17:
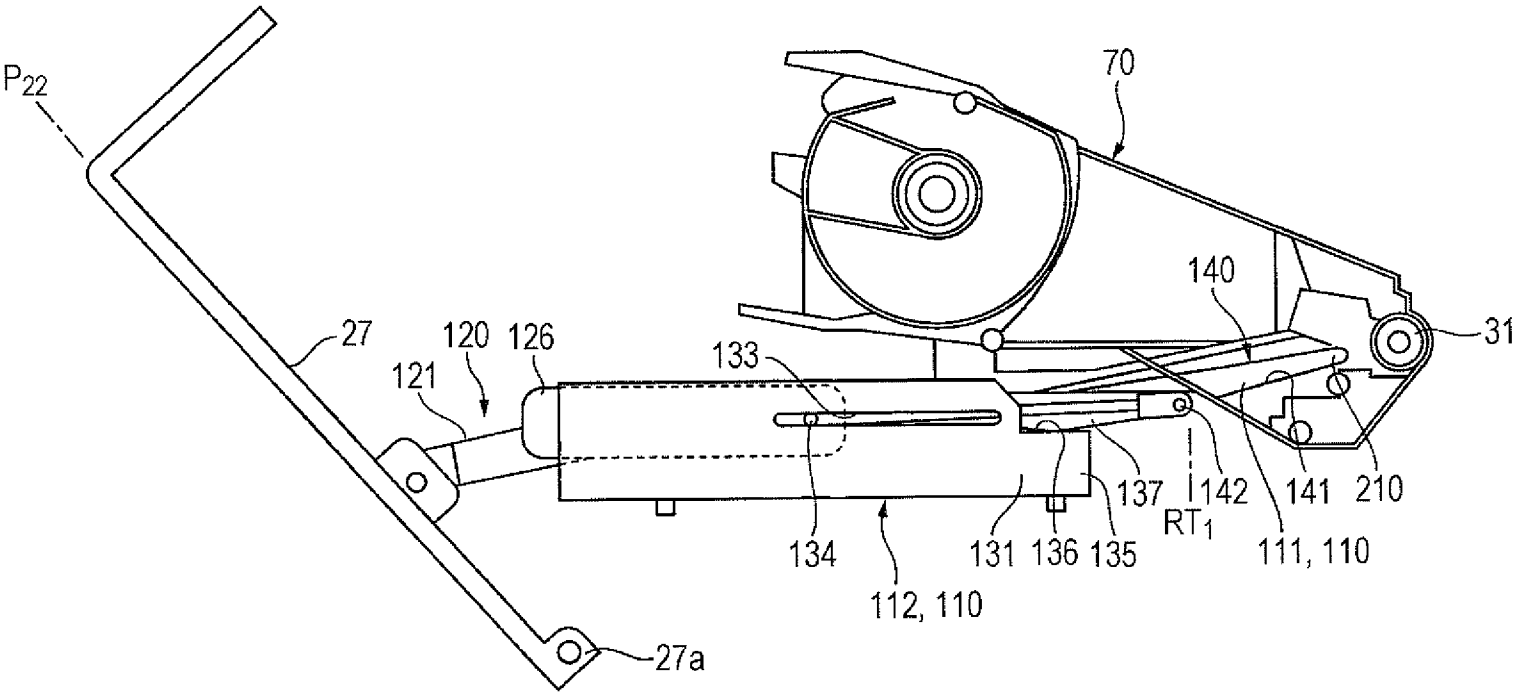
FIG. 17 illustrates an operational process (3) of the guide mechanism associated with opening of the opening and closing door.

Thereafter, if the opening and closing door 27 is further opened to move to the intermediate open position $P_{22}$ as illustrated in FIG. 17, the second interlock arm 126 is further drawn out toward the opening and closing door 27 via the interlock mechanism 120. As a result, the holder 101 is drawn out, causing the image writer 33 to reach the intermediate retracted position $RT_1$ located outside the attaching object receiving portion 140 of the process cartridge 70.

In this state, the guided pin 142, which is provided in the embracing portion 102 of the holder 101, moves out of the guide path running along the guide groove 141 of the process cartridge 70. Consequently, the first inclined portion **138*a* of the rib 137 formed on the lower surface of the holder 101 of the image writer 33 comes into contact with the guide surface 136 of the guide base 135. Therefore, with the guide pin 134 as a pivot point, the holder 101 is arranged on the guide surface 136 of the guide base 135 via the rib 137. As a result, in the intermediate retracted position $RT_1$, the image writer 33** is held at a predetermined position without falling downward.

Thereafter, when the opening and closing door 27 is further opened to move to the final open position $P_3$ as illustrated in FIG. 18, the second interlock arm 126 of the interlock mechanism 120 is further drawn out toward the opening and closing door 27, and the guide pin 134 of the second interlock arm 126 slides along the guide groove 133 of the guide rail 131. Accordingly, the holder 101 is further drawn out, and the first inclined portion **138*a* of the rib 137 of the holder 101 moves while in contact with the guide surface 136. As a result, in response to changes in the contact position between the first inclined portion 138*a* of the rib 137 and the guide surface 136, the image writer 33 held by the holder 101 gradually changes to a substantially horizontal orientation. In this way, the image writer 33 retracts to the retracted position RT located farther away from the process cartridge 70** than the intermediate retracted position $RT_1$.

Since the retracted position RT is located outside the space for attaching and detaching the process cartridge 70, the process cartridge 70 and the image writer 33 retracted to the retracted position RT do not interfere with each other at the time of attaching or detaching the process cartridge 70.

Next, a case will be described in which, at the time of replacing the process cartridge 70, the opening and closing door 27 is closed from the open position $P_3$ to the close position $P_1$ after the process cartridge 70 is attached to the cartridge receiving portion inside the apparatus housing 21.

Now, as illustrated in FIG. 18, when the opening and closing door 27 is started to close from the open position $P_3$ after the process cartridge 70 is attached, the guide mechanism 110 (the first guide mechanism 111 and the second guide mechanism 112) guides the image writer 33 via the interlock mechanism 120 along a predetermined guide path.

In the present example, upon starting to close the opening and closing door 27, the second interlock arm 126 of the interlock mechanism 120 is pushed into the apparatus housing 21 in conjunction with operation of the first interlock arm 121. Accordingly, the image writer 33 moves toward the photoconductor 31 via the holder 101.

At this time, in the second guide mechanism 112, the guide pin 134 of the second interlock arm 126 moves linearly along the guide groove 133 of the guide rail 131, and the first inclined portion **138*a* of the rib 137, which is formed on the lower surface on either side of the width direction of the holder 101 of the image writer 33, moves while in contact with the guide surface 136 of the guide base 135. Accordingly, with the guide pin 134 as a pivot point, the holder 101 is gradually lifted up from the guide surface 136 by the first inclined portion 138*a* of the rib 137**.

Therefore, the image writer 33 moves along a curved guide path m2 (see FIG. 20) while gradually changing from a substantially horizontal orientation to an orientation in which the distal end side of the image writer 33 is lifted up.

Figure 20:
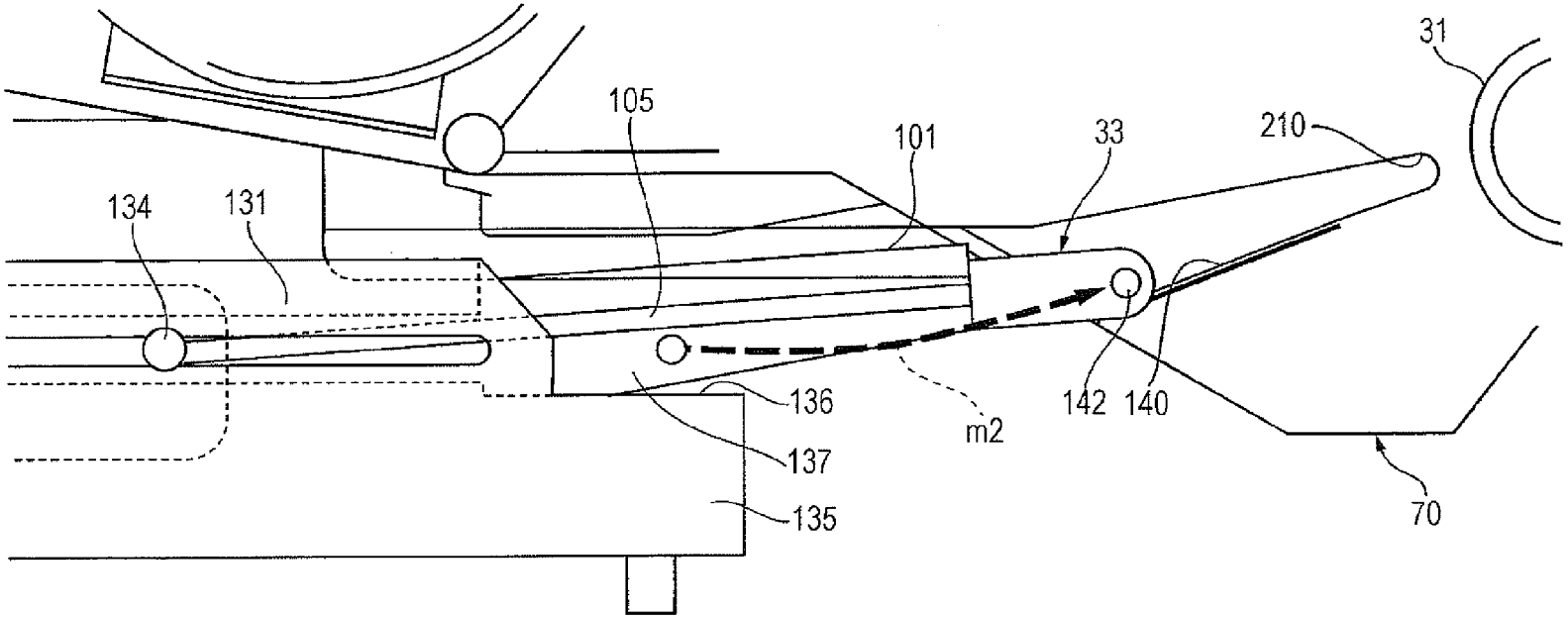
FIG. 20 illustrates guiding of the image writer associated with the closing process of the opening and closing door.

Thereafter, as the opening and closing door 27 is closed to the intermediate open position $P_n$ as illustrated in FIG. 17, the interlock mechanism 120 further pushes the second interlock arm 126 in, and thus the second guide mechanism 112 further moves the image writer 33 toward the photoconductor 31 along the curved guide path m2 (see FIG. 20). As a result, the image writer 33 reaches the position immediately in front of the attaching object receiving portion 140 of the process cartridge 70.

Thereafter, as the opening and closing door 27 is further closed to the intermediate open position $P_{21}$ as illustrated in FIG. 16, the interlock mechanism 120 operates in conjunction with the closing action of the opening and closing door 27 to further push the second interlock arm 126 in, and the second interlock arm 126 pushes the image writer 33 in to the attaching object receiving portion 140 of the process cartridge 70 via the holder 101.

At this time, the second guide mechanism 112 moves the image writer 33 in a state in which the first inclined portion 138*a* of the rib 137 of the holder 101 is in contact with the guide surface 136 of the guide base 135. Then, by gradually changing the tilt orientation of the holder 101 to change the orientation of the image writer 33, the second guide mechanism 112 guides the image writer 33 in such a way that the image writer 33 is inserted into the attaching object receiving portion 140 of the process cartridge 70.

Figure 19:
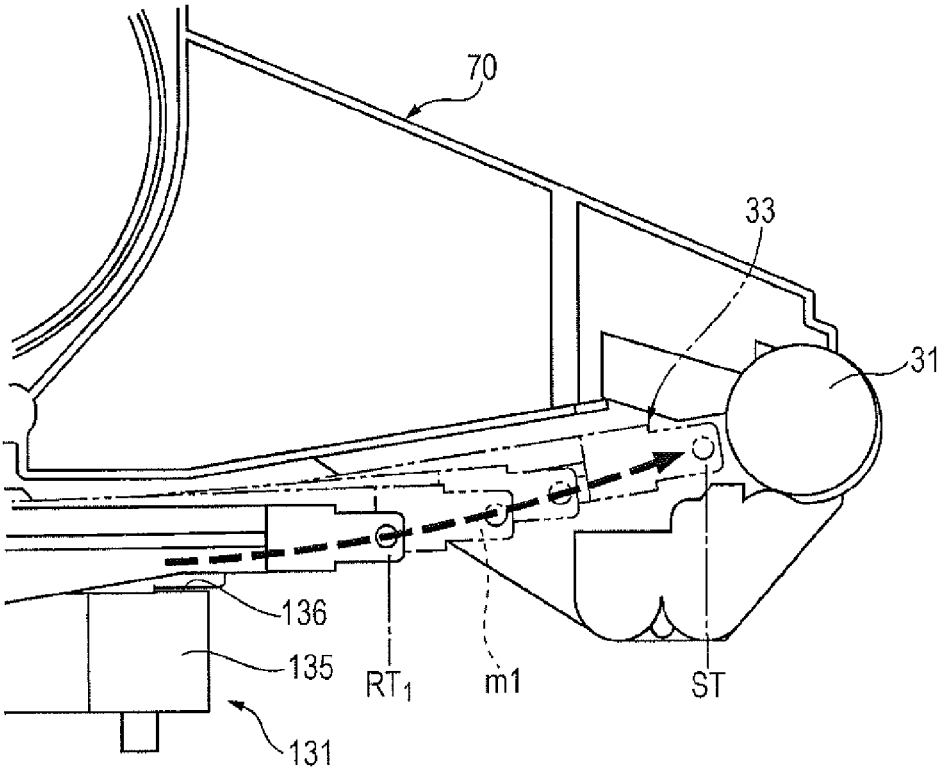
FIG. 19 illustrates a guide path of the image writer associated with the closing process of the opening and closing door.

Thereafter, when the image writer 33 is inserted into the attaching object receiving portion 140 of the process cartridge 70 as illustrated in FIGS. 19 and 20, guiding of the image writer 33 by the first guide mechanism 111 is started. That is, the guided pin 142, which is provided on either side of the embracing portion 102 of the holder 101, moves along the guide groove 141 having a linear shape inside the attaching object receiving portion 140. As a result, the image writer 33 moves toward the photoconductor 31 along a linear guide path m1.

At this time, guiding of the image writer 33 by the second guide mechanism 112 is removed when guiding by the first guide mechanism 111 is started. That is, as the image writer 33 moves toward the photoconductor 31, the first inclined portion 138*a* of the rib 137 formed on the holder 101 moves past the guide surface 136 of the guide base 135, and the second inclined portion 138*b* of the rib 137 moves to a position corresponding to the guide surface 136 of the guide base 135. Accordingly, the rib 137 is arranged in a non-contact state with respect to the guide surface 136.

Then, upon closing the opening and closing door 27 to the close position $P_1$ as illustrated in FIG. 15, the interlock mechanism 120 operates in conjunction with the closing action of the opening and closing door 27 to further push the second interlock arm 126 in, causing the image writer 33 to be pushed in along the attaching object receiving portion 140 of the process cartridge 70 via the holder 101.

At this time, since the image writer 33 is urged by the urging spring 103 in the embracing portion 102 of the holder 101, when the image writer 33 comes into abutment with the positioning portion 210 (see FIG. 17) that is determined in advance, the image writer 33 stops its movement and is positioned in the positioning portion 210. At this stage, the image writer 33 is set in a predetermined write position ST.

<Guiding of Coupling Component and Restricting Component>

Next, guiding of the coupling component 161 or 162 and the restricting component 170 by the guide mechanism 180 will be described.

Now, in a state in which the opening and closing door 27 is in the close position $P_1$ as illustrated in FIG. 15, the coupling component 161 or 162 is set in the coupling position CS, and the restricting component 170 is also set in the restricting position KS. Therefore, the driving force from the drive transmission system 150 is transmitted to the photoconductor 31 or the developing unit 34 of the process cartridge 70 via the coupling component 161 or 162. Since dislodging of the photoconductor 31 at either axial end is restricted by the restricting component 170, the photoconductor 31 is unlikely to become dislodged in the axial direction during rotation of the photoconductor 31.

In this state, as the opening and closing door 27 is opened toward the open position $P_3$ as illustrated in FIGS. 16 and 17, the interlock mechanism 120 operates in conjunction with the opening action of the opening and closing door 27, causing the guide mechanism 110 for the image writer to operate.

At this time, the guide pin 134 of the second interlock arm 126 of the interlock mechanism 120 moves along the guide groove 133 of the guide rail 131, and also moves along the first guide groove 183 of each of the link arms 181 and 201 of the guide mechanism 180 for the coupling component and the restricting component.

In this state, the guide pin 134 slidably fits in the first guide groove 183 of each of the link arms 181 and 201. While the opening and closing door 27 is opened from the close position $P_1$ to the intermediate open position $P_{22}$, as illustrated in FIG. 21B, the guide pin 134 slides by the distance s1 along the guide groove 133 and reaches the end edge on the opening and closing door 27 side of the guide groove 133. At this time, a driving force has not yet been transmitted to the link arms 181 and 201, and thus the coupling component 161 or 162 and the restricting component 170 are still arranged in the coupling position CS and the restricting position KS, respectively.

That is, in the present example, until the guide mechanism 110 for the image writer retracts the image writer 33 to the intermediate retracted position $RT_1$, the guide mechanism 180 for the coupling component and the restricting component does not retract the coupling component 161 or 162 and the restricting component 170. Therefore, the coupling component 161 or 162 and the restricting component 170 are prevented from moving to the retracted position RT to allow movement of the process cartridge 70 before the image writer 33 is retracted to the intermediate retracted position $RT_1$.

Thereafter, upon opening the opening and closing door 27 to the open position $P_3$ as illustrated in FIG. 18, as illustrated in FIGS. 11 to 14 and FIGS. 21A and 21B, the guide pin 134 of the second interlock arm 126 reaches the end edge on the opening and closing door 27 side of the first guide groove 183 in each of the link arms 181 and 201. While the opening and closing door 27 moves from the intermediate open position $P_{22}$ to the open position $P_3$, the link arms 181 and 201 are drawn out toward the opening and closing door 27.

As the link arms 181 and 201 move toward the opening and closing door 27 by the distance s2 in this state, in the link arms 181 and 201, the hook pin 188 of the first link holder 187, and the hook pin 191 of the second link holder 190 move obliquely downward along the third guide groove 185. Accordingly, the first link holder 187 and the second link holder 190 are guided downward. As a result, the coupling component 161 or 162 held by the first link holder 187 moves to the retracted position RT retracted from the coupling position CS, and the restricting component 170 held by the second link holder 190 moves to the retracted position RT retracted from the restricting position KS.

In this state, the coupling component 161 or 162 and the restricting component 170 have retracted to the retracted position RT located outside the coupling position CS and the restricting position KS, respectively. Therefore, the process cartridge 70 does not interfere with the coupling component 161 or 162 and the restricting component 170 at the time of attaching or detaching the process cartridge 70.

When the opening and closing door 27 is to be closed from the open position $P_3$ to the close position $P_1$ after the process cartridge 70 is attached, as illustrated in FIGS. 15 to 18 and FIGS. 21A and 21B, the guide mechanism 180 operates in conjunction with the closing action of the opening and closing door 27 via the interlock mechanism 120 and the guide mechanism 110 for the image writer.

In the present example, the link arms 181 and 201 are pushed into the apparatus housing 21 while the opening and closing door 27 is closed from the open position $P_3$ to the intermediate open position $P_{22}$. Accordingly, the coupling component 161 or 162 and the restricting component 170 are set in the coupling position CS and the restricting position KS, respectively.

Thereafter, even when the opening and closing door 27 is closed to the close position $P_1$, the link arms 181 and 201 do not move, and the coupling component 161 or 162 and the restricting component 170 remain to be set in the coupling position CS and the restricting position KS, respectively.

Modification

In Exemplary Embodiment 1, each of the image writer 33, the coupling component 161 or 162, and the restricting component 170 may be retracted to the retracted position by the corresponding guide mechanisms that operate in conjunction with the opening and closing door 27. However, this is not to be construed restrictively. For example, in an alternative configuration, only the image writer 33 may be retracted from its write position by a guide mechanism that operates in conjunction with the opening and closing door 27.

Figure 22:
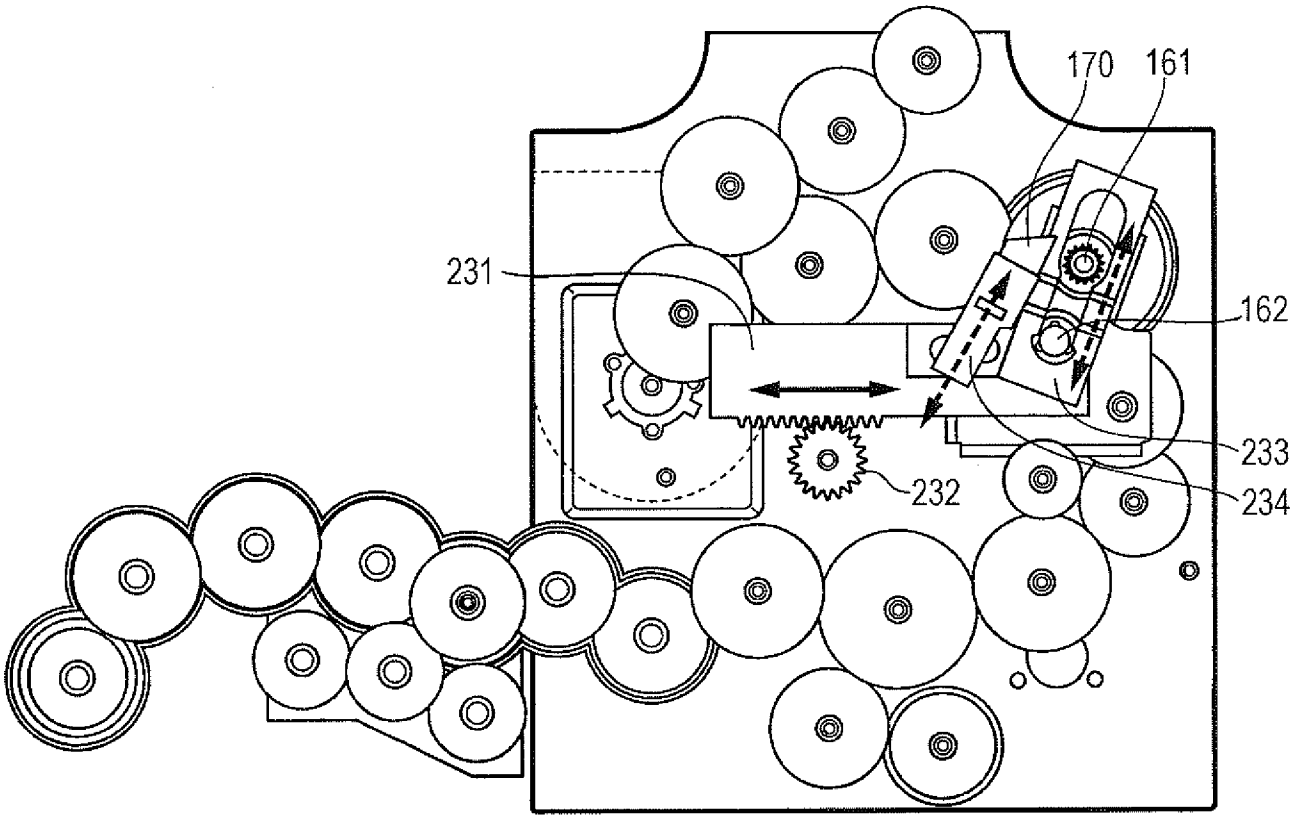
FIG. 22 illustrates a modification of the guide mechanism for the coupling component and the restricting component.

That is, in Exemplary Embodiment 1, the link arms 181 and 201 are adopted for the guide mechanism 180 for the coupling component and the restricting component. However, for the coupling component 161 or 162 or the restricting component 170, for example, as illustrated in FIG. 22, it is of course possible to use a combination of a rack 231 and a pinion 232 without using the guide mechanism 180. That is, the pinion 232 is driven by a drive source (not illustrated) to enable advancing and retracting movement of the rack 231, and this advancing and retracting movement of the rack 231 is used to advance or retract members 233 and 234, which respectively hold the coupling component 161 or 162 and the restricting component 170, between the coupling position or restricting position and the retracted position.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising an apparatus housing that has an opening and closing door that opens and closes between a close position and an open position;

an attaching body that includes an image carrier that carries an image, the attaching body being detachably attached inside the apparatus housing through an opening of the opening and closing door in a direction crossing an axial direction of the image carrier;

an image writer that is opposed to the image carrier to write an image onto the image carrier; and a guide mechanism that moves the image writer in conjunction with opening and closing of the opening and closing door, the guide mechanism guiding the image writer to a write position upon closing of the opening and closing door and guiding the image writer to a retracted position upon opening of the opening and closing door, the retracted position being a position in which the image writer is retracted from a space for attaching and detaching the attaching body, wherein the guide mechanism has a first guide mechanism that has a first guide portion provided in the attaching body, the first guide mechanism guiding the image writer along the first guide portion while the opening and closing door moves from the close position to an intermediate position, the intermediate position being located between the close position and the open position, and a second guide mechanism that has a second guide portion provided in the apparatus housing, the second guide mechanism guiding the image writer along the second guide portion while the opening and closing door moves from the intermediate position to the open position, wherein the attaching body has a driven component including the image carrier;

the image forming apparatus further comprises:

a drive transmission system that transmits a driving force to the driven component, the drive transmission system having a coupling component that couples to the driven component, and a coupling-component guide mechanism that moves the coupling component in conjunction with opening and closing of the opening and closing door, the coupling-component guide mechanism guiding the coupling component to a coupling position upon closing of the opening and closing door and guiding the coupling component to a retracted position upon opening of the opening and closing door, the retracted position being a position in which the coupling component is retracted from the space for attaching and detaching the attaching body; and when the opening and closing door is opened from the close position to the open position, the coupling-component guide mechanism moves the coupling component to the retracted position after guiding of the image writer by the second guide mechanism is started.

2. The image forming apparatus according to claim 1, wherein when the opening and closing door is opened from the close position to the open position, the coupling-component guide mechanism moves the coupling component to the retracted position after the image writer leaves the first guide portion provided in the attaching body.

3. The image forming apparatus according to claim 1, wherein:

the attaching body includes a developing unit as the driven component, the developing unit developing the image written onto the image carrier by the image writer into a visible image, the developing unit having a developing member; and the coupling component guided to the coupling position and the retracted position by the coupling-component guide mechanism is capable of coupling to the driven component including the image carrier and the developing member of the developing unit.

4. The image forming apparatus according to claim 1, wherein the coupling-component guide mechanism operates in conjunction with opening and closing of the opening and closing door via the guide mechanism.

5. The image forming apparatus according to claim 4, wherein:

the coupling-component guide mechanism guides the coupling component by an amount of guide smaller than an amount of guide by the guide mechanism;

the guide mechanism has a movable member; and the coupling-component guide mechanism has a portion that engages with the movable member of the guide mechanism via an elongated hole to absorb a difference in the amount of guide between the coupling-component guide mechanism and the guide mechanism.

6. The image forming apparatus according to claim 1, further comprising:

a restricting component that restricts dislodging of the image carrier in the axial direction; and a restricting-component guide mechanism that moves the restricting component in conjunction with opening and closing of the opening and closing door, the restricting-component guide mechanism guiding the restricting component to a restricting position upon closing of the opening and closing door and guiding the restricting component to a retracted position upon opening of the opening and closing door, the retracted position being a position retracted from the space for attaching and detaching the attaching body, wherein when the opening and closing door is opened from the close position to the open position, the restricting-component guide mechanism moves the restricting component to the retracted position after guiding of the image writer by the second guide mechanism is started.

7. An image forming apparatus comprising:

an apparatus housing that has an opening and closing door that opens and closes between a close position and an open position;

an attaching body that includes an image carrier that carries an image, the attaching body being detachably attached inside the apparatus housing through an opening of the opening and closing door in a direction crossing an axial direction of the image carrier;

an image writer that is opposed to the image carrier to write an image onto the image carrier; and a guide mechanism that moves the image writer in conjunction with opening and closing of the opening and closing door, the guide mechanism guiding the image writer to a write position upon closing of the opening and closing door and guiding the image writer to a retracted position upon opening of the opening and closing door, the retracted position being a position in which the image writer is retracted from a space for attaching and detaching the attaching body, wherein the guide mechanism has a first guide mechanism that has a first guide portion provided in the attaching body, the first guide mechanism guiding the image writer along the first guide portion while the opening and closing door moves from the close position to an intermediate position, the intermediate position being located between the close position and the open position, and a second guide mechanism that has a second guide portion provided in the apparatus housing, the second guide mechanism guiding the image writer along the second guide portion while the opening and closing door moves from the intermediate position to the open position, a restricting component that restricts dislodging of the image carrier in the axial direction; and a restricting-component guide mechanism that moves the restricting component in conjunction with opening and closing of the opening and closing door, the restricting-component guide mechanism guiding the restricting component to a restricting position upon closing of the opening and closing door and guiding the restricting component to a retracted position upon opening of the opening and closing door, the retracted position being a position in which the restricting component is retracted from the space for attaching and detaching the attaching body, wherein when the opening and closing door is opened from the close position to the open position, the restricting-component guide mechanism moves the restricting component to the retracted position after guiding of the image writer by the second guide mechanism is started.

8. The image forming apparatus according to claim 7, wherein the restricting-component guide mechanism operates in conjunction with opening and closing of the opening and closing door via the guide mechanism.

* * * * *